US009826327B2

(12) United States Patent
Law et al.

(10) Patent No.: US 9,826,327 B2
(45) Date of Patent: Nov. 21, 2017

(54) RENDERING OF MULTICHANNEL AUDIO USING INTERPOLATED MATRICES

(71) Applicant: Dolby Laboratories Licensing Corporation, San Francisco, CA (US)

(72) Inventors: Malcolm James Law, Steyning (GB); Vinay Melkote, San Mateo, CA (US); Rhonda Wilson, San Francisco, CA (US); Simon Plain, San Francisco, CA (US); Andy Jaspar, Walnut Creek, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/024,925

(22) PCT Filed: Sep. 26, 2014

(86) PCT No.: PCT/US2014/057611

§ 371 (c)(1),
(2) Date: Mar. 25, 2016

(87) PCT Pub. No.: WO2015/048387

PCT Pub. Date: Apr. 2, 2015

(65) Prior Publication Data

US 2016/0241981 A1 Aug. 18, 2016

Related U.S. Application Data

(60) Provisional application No. 61/883,890, filed on Sep. 27, 2013.

(51) Int. Cl.
*H04S 3/02* (2006.01)
*G10L 19/018* (2013.01)
(Continued)

(52) U.S. Cl.
CPC ..... *H04S 3/02* (2013.01); *G10L 19/008* (2013.01); *G10L 19/018* (2013.01); *G10L 19/24* (2013.01); *H04S 2400/03* (2013.01)

(58) Field of Classification Search
None
See application file for complete search history.

(56) References Cited

U.S. PATENT DOCUMENTS 6,611,212 B1 8/2003 Craven
6,774,820 B2 * 8/2004 Craven ..... G11B 20/00992 341/200

(Continued)

FOREIGN PATENT DOCUMENTS

RS 1332 U 8/2013
RU 2393550 6/2010

(Continued)

OTHER PUBLICATIONS

Gerzon, M. et al "The MLP Lossless Compression System for PCM Audio" JAES vol. 52, Issue 3, pp. 243-260, Mar. 15, 2004.

(Continued)

*Primary Examiner* — Curtis Kuntz
*Assistant Examiner* — Qin Zhu

(57) ABSTRACT

Methods which uses interpolated primitive matrices to decode encoded audio to recover (losslessly) content of a multichannel audio program and/or to recover at least one downmix of such content, and encoding methods for generating such encoded audio. In some embodiments, a decoder performs interpolation on a set of seed primitive matrices to determine interpolated matrices for use in rendering channels of the program. Other aspects are a system or device configured to implement any embodiment of the method.

20 Claims, 6 Drawing Sheets

(51) Int. Cl.
*G10L 19/24* (2013.01)
*G10L 19/008* (2013.01)

(56) References Cited

U.S. PATENT DOCUMENTS

| | | | | |
|---|---|---|---|---|
| 7,123,652 | B1 | 10/2006 | McNeely | |
| 7,193,538 | B2 * | 3/2007 | Craven | G11B 20/00992 341/50 |
| 8,107,571 | B2 | 1/2012 | Sullivan | |
| 8,249,883 | B2 | 8/2012 | Mehrotra | |
| 2008/0031463 | A1 | 2/2008 | Davis | |
| 2011/0137662 | A1 * | 6/2011 | McGrath | G10L 19/008 704/500 |
| 2011/0182432 | A1 | 7/2011 | Ishikawa | |
| 2011/0317842 | A1 * | 12/2011 | Neusinger | G10L 19/008 381/22 |

FOREIGN PATENT DOCUMENTS

| | | |
|---|---|---|
| WO | 00/60746 | 12/2000 |
| WO | 2006/062993 | 6/2006 |
| WO | 2007/029412 | 3/2007 |
| WO | 2008/034723 | 3/2008 |
| WO | 2011/119401 | 9/2011 |

OTHER PUBLICATIONS

Etemoglu, C.O. et al "Spectral Magnitude Quantization based on Linear Transforms for 4 kb/s Speech Coding" IEEE International Conference on Acoustics, Speech, and Signal Processing, vol. 2; pp. 701-704, May 7-11, 2001.

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

Stanojevic, Tomislav "Surround Sound for a New Generation of Theaters," Sound and Video Contractor, Dec. 20, 1995, 7 pages.

Stanojevic, Tomislav "Virtual Sound Sources in the Total Surround Sound System," SMPTE Conf. Proc.,1995, pp. 405-421.

Stanojevic, Tomislav et al. "Designing of TSS Halls," 13th International Congress on Acoustics, Yugoslavia, 1989, pp. 326-331.

Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.

Stanojevic, Tomislav et al. "The Total Surround Sound (TSS) Processor," SMPTE Journal, Nov. 1994, pp. 734-740.

Stanojevic, Tomislav et al. "The Total Surround Sound System (TSS System)", 86th AES Convention, Hamburg, Germany, Mar. 7-10, 1989, 21 pages.

Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.

Stanojevic, Tomislav et al. "TSS System and Live Performance Sound" 88th AES Convention, Montreux, Switzerland, Mar. 13-16, 1990, 27 pages.

ISO/IEC FDIS 23003-1:2006(E) Information Technology—MPEG Audio Technologies, Part 1: MPEG Surround, ISO/IEC JTC 1/SC 29/WG 11, Jul. 21, 2006.

* cited by examiner

RENDERING OF MULTICHANNEL AUDIO USING INTERPOLATED MATRICES

CROSS-REFERENCE TO RELATED APPLICATIONS

This application claims priority from U.S. Provisional Patent Application No. 61/883,890 filed 27 Sep. 2013 which is hereby incorporated by reference in its entirety.

TECHNICAL FIELD

The invention pertains to audio signal processing, and more particularly to rendering of multichannel audio programs (e.g., bitstreams indicative of object-based audio programs including at least one audio object channel and at least one speaker channel) using interpolated matrices, and to encoding and decoding of the programs. In some embodiments, a decoder performs interpolation on a set of seed primitive matrices to determine interpolated matrices for use in rendering channels of the program. Some embodiments generate, decode, and/or render audio data in the format known as Dolby TrueHD.

BACKGROUND

Dolby and Dolby TrueHD are trademarks of Dolby Laboratories Licensing Corporation.

The complexity, and financial and computational cost, of rendering audio programs increases with the number of channels to be rendered. During rendering and playback of object based audio programs, the audio content has a number of channels (e.g., object channels and speaker channels) which is typically much larger (e.g., by an order of magnitude) than the number occurring during rendering and playback of conventional speaker-channel based programs. Typically also, the speaker system used for playback includes a much larger number of speakers than the number employed for playback of conventional speaker-channel based programs.

Although embodiments of the invention are useful for rendering channels of any multichannel audio program, many embodiments of the invention are especially useful for rendering channels of object-based audio programs having a large number of channels.

It is known to employ playback systems (e.g., in movie theaters) to render object based audio programs. Object based audio programs may be indicative of many different audio objects corresponding to images on a screen, dialog, noises, and sound effects that emanate from different places on (or relative to) the screen, as well as background music and ambient effects (which may be indicated by speaker channels of the program) to create the intended overall auditory experience. Accurate playback of such programs requires that sounds be reproduced in a way that corresponds as closely as possible to what is intended by the content creator with respect to audio object size, position, intensity, movement, and depth.

During generation of object based audio programs, it is typically assumed that the loudspeakers to be employed for rendering are located in arbitrary locations in the playback environment; not necessarily in a predetermined arrangement in a (nominally) horizontal plane or in any other predetermined arrangement known at the time of program generation. Typically, metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment).

Object based audio programs represent a significant improvement in many respects over traditional speaker channel-based audio programs, since speaker-channel based audio is more limited with respect to spatial playback of specific audio objects than is object channel based audio. Speaker channel-based audio programs consist of speaker channels only (not object channels), and each speaker channel typically determines a speaker feed for a specific, individual speaker in a listening environment.

Various methods and systems for generating and rendering object based audio programs have been proposed. During generation of an object based audio program, it is typically assumed that an arbitrary number of loudspeakers will be employed for playback of the program, and that the loudspeakers to be employed for playback will be located in arbitrary locations in the playback environment; not necessarily in a (nominally) horizontal plane or in any other predetermined arrangement known at the time of program generation. Typically, object-related metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment). Examples of rendering of object based audio programs are described, for example, in PCT International Application No. PCT/US2001/028783, published under International Publication No. WO 2011/119401 A2 on Sep. 29, 2011, and assigned to the assignee of the present application.

An object-based audio program may include "bed" channels. A bed channel may be an object channel indicative of an object whose position does not change over the relevant time interval (and so is typically rendered using a set of playback system speakers having static speaker locations), or it may be a speaker channel (to be rendered by a specific speaker of a playback system). Bed channels do not have corresponding time varying position metadata (though they may be considered to have time-invariant position metadata). They may by indicative of audio elements that are dispersed in space, for instance, audio indicative of ambience.

Playback of an object-based audio program over a traditional speaker set-up (e.g., a 7.1 playback system) is achieved by rendering channels of the program (including object channels) to a set of speaker feeds. In typical embodiments of the invention, the process of rendering object channels (sometimes referred to herein as objects) and other channels of an object-based audio program (or channels of an audio program of another type) comprises in large part (or solely) a conversion of spatial metadata (for the channels to be rendered) at each time instant into a corresponding gain matrix (referred to herein as a "rendering matrix") which represents how much each of the channels (e.g., object channels and speaker channels) contributes to a mix of audio content (at the instant) indicated by the speaker feed for a particular speaker (i.e., the relative weight of each of the channels of the program in the mix indicated by the speaker feed).

An "object channel" of an object-based audio program is indicative of a sequence of samples indicative of an audio object, and the program typically includes a sequence of spatial position metadata values indicative of object position or trajectory for each object channel. In typical embodiments of the invention, sequences of position metadata values corresponding to object channels of a program are used to determine an M×N matrix A(t) indicative of a time-varying gain specification for the program.

Rendering of "N" channels (e.g., object channels, or object channels and speaker channels) of an audio program to "M" speakers (speaker feeds) at time "/" of the program can be represented by multiplication of a vector x(t) of length "N", comprised of an audio sample at time "t" from each channel, by an M×N matrix A(t) determined from associated position metadata (and optionally other metadata corresponding to the audio content to be rendered, e.g., object gains) at time "t". The resultant values (e.g., gains or levels) of the speaker feeds at time t can be represented as a vector y(t), as in the following equation (1):

$$\underbrace{\begin{bmatrix} y_0(t) \\ y_1(t) \\ \vdots \\ y_{M-1}(t) \end{bmatrix}}_{y(t)} = \underbrace{\begin{bmatrix} a_{00}(t) & a_{01}(t) & a_{02}(t) & \ddots & a_{0,N-1}(t) \\ a_{10}(t) & \ddots & \ddots & \ddots & \ddots \\ \ddots & \ddots & \ddots & \ddots & \ddots \\ a_{M-1,0}(t) & \ddots & \ddots & \ddots & a_{M-1,N-1}(t) \end{bmatrix}}_{A(t)} \underbrace{\begin{bmatrix} x_0(t) \\ x_1(t) \\ x_2(t) \\ \vdots \\ x_{N-1}(t) \end{bmatrix}}_{x(t)}. \quad (1)$$

Although equation (1) describes the rendering of N channels of an audio program (e.g., an object-based audio program, or an encoded version of an object-based audio program) into M output channels (e.g., M speaker feeds), it also represents a generic set of scenarios in which a set of N audio samples is converted to a set of M values (e.g., M samples) by linear operations. For example, A(t) could be a static matrix, "A", whose coefficients do not vary with different values of time "t". For another example, A(t) (which could be a static matrix, A) could represent a conventional downmix of a set of speaker channels x(t) to a smaller set of speaker channels y(t) (or x(t) could be a set of audio channels that describe a spatial scene in an Ambisonics format), and the conversion to speaker feeds y(t) could be prescribed as multiplication by the downmix matrix A. Even in an application employing a nominally static downmix matrix, the actual linear transformation (matrix multiplication) applied may be dynamic in order to ensure clip-protection of the downmix (i.e., a static transformation A may be converted to a time-varying transformation A(t), to ensure clip-protection).

An audio program rendering system (e.g., a decoder implementing such a system) may receive metadata which determine rendering matrices A(t) (or it may receive the matrices themselves) only intermittently and not at every instant "t" during a program. For example, this could be due to any of a variety of reasons, e.g., low time resolution of the system that actually outputs the metadata or the need to limit the bit rate of transmission of the program. The inventors have recognized that it may be desirable for a rendering system to interpolate between rendering matrices A(t1) and A(t2), at time instants "t1" and "t2" during a program, respectively, to obtain a rendering matrix A(t3) for an intermediate time instant "t3." Interpolation ensures that the perceived position of objects in the rendered speaker feeds varies smoothly over time, and may eliminate undesirable artifacts such as zipper noise that stem from discontinuous (piece-wise constant) matrix updates. The interpolation may be linear (or nonlinear), and typically should ensure a continuous path in time from A(t1) to A(t2).

Dolby TrueHD is a conventional audio codec format that supports lossless and scalable transmission of audio signals. The source audio is encoded into a hierarchy of substreams of channels, and a selected subset of the substreams (rather than all of the substreams) may be retrieved from the bitstream and decoded, in order to obtain a lower dimensional (downmix) presentation of the spatial scene. When all the substreams are decoded, the resultant audio is identical to the source audio (the encoding, followed by the decoding, is lossless).

In a commercially available version of TrueHD, the source audio is typically a 7.1 channel mix which is encoded into a sequence of three substreams, including a first substream which can be decoded to determine a two channel downmix of the 7.1 channel original audio. The first two substreams may be decoded to determine a 5.1 channel downmix of the original audio. All three substreams may be decoded to determine the original 7.1 channel audio. Technical details of Dolby TrueHD, and the Meridian Lossless Packing (MLP) technology on which it is based, are well known. Aspects of TrueHD and MLP technology are described in U.S. Pat. No. 6,611,212, issued Aug. 26, 2003, and assigned to Dolby Laboratories Licensing Corp., and the paper by Gerzon, et al., entitled "The MLP Lossless Compression System for PCM Audio," J. AES, Vol. 52, No. 3, pp. 243-260 (March 2004).

TrueHD supports specification of downmix matrices. In typical use, the content creator of a 7.1 channel audio program specifies a static matrix to downmix the 7.1 channel program to a 5.1 channel mix, and another static matrix to downmix the 5.1 channel downmix to a 2 channel downmix. Each static downmix matrix may be converted to a sequence of downmix matrices (each matrix in the sequence for downmixing a different interval in the program) in order to achieve clip-protection. However, each matrix in the sequence is transmitted (or metadata determining each matrix in the sequence is transmitted) to the decoder, and the decoder does not perform interpolation on any previously specified downmix matrix to determine a subsequent matrix in a sequence of downmix matrices for a program.

FIG. 1 is a schematic diagram of elements of a conventional TrueHD system, in which the encoder (30) and decoder (32) are configured to implement matrixing operations on audio samples. In the FIG. 1 system, encoder 30 is configured to encode an 8-channel audio program (e.g., a traditional set of 7.1 speaker feeds) as an encoded bitstream including two substreams, and decoder 32 is configured to decode the encoded bitstream to render either the original 8-channel program (losslessly) or a 2-channel downmix of the original 8-channel program. Encoder 30 is coupled and configured to generate the encoded bitstream and to assert the encoded bitstream to delivery system 31.

Delivery system 31 is coupled and configured to deliver (e.g., by storing and/or transmitting) the encoded bitstream to decoder 32. In some embodiments, system 31 implements delivery of (e.g., transmits) an encoded multichannel audio program over a broadcast system or a network (e.g., the internet) to decoder 32. In some embodiments, system 31 stores an encoded multichannel audio program in a storage medium (e.g., a disk or set of disks), and decoder 32 is configured to read the program from the storage medium.

The block labeled "InvChAssign1" in encoder 30 is configured to perform channel permutation (equivalent to multiplication by a permutation matrix) on the channels of the input program. The permutated channels then undergo encoding in stage 33, which outputs eight encoded signal channels. The encoded signal channels may (but need not) correspond to playback speaker channels. The encoded signal channels are sometimes referred to as "internal" channels since a decoder (and/or rendering system) typically decodes and renders the content of the encoded signal channels to recover the input audio, so that the encoded signal channels are "internal" to the encoding/decoding system. The encoding performed in stage 33 is equivalent to multiplication of each set of samples of the permutated channels by an encoding matrix (implemented as a cascade of n+1 matrix multiplications, identified as $P_n^{-1}, \ldots, P_1^{-1}, P_0^{-1}$, to be described below in greater detail).

Matrix determination subsystem 34 is configured to generate data indicative of the coefficients of two sets of output matrices (one set corresponding to each of two substreams of the encoded channels). One set of output matrices consists of two matrices, $P_0^2, P_1^2$, each of which is a primitive matrix (defined below) of dimension 2×2, and is for rendering a first substream (a downmix substream) comprising two of the encoded audio channels of the encoded bitstream (to render a two-channel downmix of the eight-channel input audio). The other set of output matrices consists of rendering matrices, $P_0, P_1, \ldots, P_n$, each of which is a primitive matrix, and is for rendering a second substream comprising all eight of the encoded audio channels of the encoded bitstream (for lossless recovery of the eight-channel input audio program). A cascade of the matrices, $P_0^2, P_1^2$, along with the matrices $P_0^{2-1}, P_{10}^{-1}, \ldots, P_n^{-1}$, applied to the audio at the encoder, is equal to the downmix matrix specification that transforms the 8 input audio channels to the 2-channel downmix, and a cascade of the matrices, $P_0, P_1, \ldots, P_n$, renders the 8 encoded channels of the encoded bitstream back into the original 8 input channels.

The coefficients (of each of matrix) that are output from subsystem 34 to packing subsystem 35 are metadata indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker.

The eight encoded audio channels (output from encoding stage 33), the output matrix coefficients (generated by subsystem 34), and typically also additional data are asserted to packing subsystem 35, which assembles them into the encoded bitstream which is then asserted to delivery system 31.

The encoded bitstream includes data indicative of the eight encoded audio channels, the two sets of output matrices (one set corresponding to each of two substreams of the encoded channels), and typically also additional data (e.g., metadata regarding the audio content).

Parsing subsystem 36 of decoder 32 is configured to accept (read or receive) the encoded bitstream from delivery system 31 and to parse the encoded bitstream. Subsystem 36 is operable to assert the substreams of the encoded bitstream, including a "first" substream comprising only two of the encoded channels of the encoded bitstream, and output matrices ($P_0^2, P_1^2$) corresponding to the first substream, to matrix multiplication stage 38 (for processing which results in a 2-channel downmix presentation of content of the original 8-channel input program). Subsystem 36 is also operable to assert the substreams of the encoded bitstream (the "second" substream comprising all eight encoded channels of the encoded bitstream) and corresponding output matrices ($P_0, P_1, \ldots, P_n$) to matrix multiplication stage 37 for processing which results in losslessly rendering the original 8-channel program.

More specifically, stage 38 multiplies two audio samples of the two channels of the first substream by a cascade of the matrices $P_0^2, P_1^2$ and each resulting set of two linearly transformed samples undergoes channel permutation (equivalent to multiplication by a permutation matrix) represented by the block titled "ChAssign0" to yield each pair of samples of the required 2 channel downmix of the 8 original audio channels. The cascade of matrixing operations performed in encoder 30 and decoder 32 is equivalent to application of a downmix matrix specification that transforms the 8 input audio channels to the 2-channel downmix.

Stage 37 multiplies each vector of eight audio samples (one from each of the full set of eight channels of the encoded bitstream) by a cascade of the matrices $P_0, P_1, \ldots, P_n$, and each resulting set of eight linearly transformed samples undergoes channel permutation (equivalent to multiplication by a permutation matrix) represented by the block titled "ChAssign1" to yield each set of eight samples of the losslessly recovered original 8-channel program. In order that the output 8 channel audio is exactly the same as the input 8 channel audio (to achieve the "lossless" characteristic of the system), the matrixing operations performed in encoder 30 should be exactly (including quantization effects) the inverse of the matrixing operations performed in decoder 32 on the lossless (second) substream of the encoded bitstream (i.e., multiplication by the cascade of matrices $P_0, P_1, \ldots, P_n$). Thus, in FIG. 1, the matrixing operations in stage 33 of encoder 30 are identified as a cascade of the inverse matrices of the matrices $P_0, P_1, \ldots, P_n$, in the opposite sequence applied in stage 37 of decoder 32, namely: $P_n^{-1}, \ldots, P_1^{-1}, P_0^{-1}$.

Decoder 32 applies the inverse of the channel permutation applied by encoder 30 (i.e., the permutation matrix represented by element "ChAssign1" of decoder 32 is the inverse of that represented by element "InvChAssign1" of encoder 30).

Given a downmix matrix specification (e.g., specification of a static matrix A that is 2×8 in dimension), an objective of a conventional TrueHD encoder implementation of encoder 30 is to design output matrices (e.g., $P_0, P_1, \ldots, P_n$ and $P_0^2, P_1^2$ of FIG. 1), and input matrices ($P_n^{-1}, \ldots, P_1^{-1}, P_0^{-1}$) and output (and input) channel assignments so that:

1. the encoded bitstream is hierarchical (i.e., in the example, the first two encoded channels are sufficient to derive the 2 channel downmix presentation, and the full set of eight encoded channels is sufficient to recover the original 8 channel program); and 2. the matrices for the topmost stream ($P_0, P_1, \ldots, P_n$ in the example) are exactly invertible so that the input audio is exactly retrievable by the decoder.

Typical computing systems work with finite precision and inverting an arbitrary invertible matrix exactly could require very large precision. TrueHD solves this problem by constraining the output matrices and input matrices (i.e., $P_0, P_1, \ldots, P_n$ and $P_n^{-1}, \ldots, P_1^{-1}, P_0^{-1}$) to be square matrices of the type known as "primitive matrices".

A primitive matrix P of dimension N×N is of the form:

$$P = \begin{bmatrix} 1 & 0 & \ddots & \ddots & 0 \\ 0 & 1 & 0 & \ddots & \ddots \\ \alpha_0 & \alpha_1 & \alpha_2 & \ddots & \alpha_{N-1} \\ \vdots & \ddots & \ddots & \ddots & \ddots \\ 0 & 0 & 0 & 0 & 1 \end{bmatrix}.$$

A primitive matrix is always a square matrix. A primitive matrix of dimension N×N is identical to the identity matrix of dimension N×N except for one (non-trivial) row (i.e., the row comprising elements $\alpha_0, \alpha_1, \alpha_2, \ldots \alpha_{N-1}$ in the example). In all other rows, the off-diagonal elements are zeros and the element shared with the diagonal has an absolute value of 1 (i.e., either+1 or −1). To simplify language in this disclosure, the drawings and descriptions will always assume that a primitive matrix has diagonal elements that are equal to +1 with the possible exception of the diagonal element in the non-trivial row. However, we note that this is without loss of generality, and ideas presented in this disclosure pertain to the general class of primitive matrices where diagonal elements may be + 1 or −1.

When a primitive matrix, P, operates on (i.e., multiplies) a vector x(t), the result is the product Px(t), which is another N-dimensional vector that is exactly the same as x(t) in all elements except one. Thus each primitive matrix can be associated with a unique channel which it manipulates (or on which it operates).

We will use the term "unit primitive matrix" herein to denote a primitive matrix in which the element shared with the diagonal (by the non-trivial row of the primitive matrix) has an absolute value of 1 (i.e., either +1 or −1). Thus, the diagonal of a unit primitive matrix consists of all positive ones, +1, or all negative ones, −1, or some positive ones and some negative ones. A primitive matrix only alters one channel of a set (vector) of samples of audio program channels, and a unit primitive matrix is also losslessly invertible due to the unit values on the diagonal. Again, to simplify the discussion herein, we will use the term unit primitive matrix to refer to a primitive matrix whose non-trivial row has a diagonal element of +1. However, all references to unit primitive matrices herein, including in the claims, are intended to cover the more generic case where a unit primitive matrix can have a non-trivial row whose shared element with the diagonal is +1 or −1.

If $\alpha_2$=1 (resulting in a unit primitive matrix having a diagonal consisting of positive ones) in the above example of primitive matrix, P, it is seen that the inverse of P is exactly:

$$P^{-1} = \begin{bmatrix} 1 & 0 & \ddots & \ddots & 0 \\ 0 & 1 & 0 & \ddots & \ddots \\ -\alpha_0 & -\alpha_1 & 1 & \ddots & -\alpha_{N-1} \\ \vdots & \ddots & \ddots & \ddots & \ddots \\ 0 & 0 & 0 & 0 & 1 \end{bmatrix}.$$

It is true in general that the inverse of a unit primitive matrix is simply determined by inverting (multiplying by −1) each of its non-trivial α coefficients which does not lie along the diagonal.

If the matrices $P_0, P_1, \ldots, P_n$ employed in decoder 32 of FIG. 1 are unit primitive matrices (having unit diagonals), the sequence of matrixing operations $P_n^{-1}, \ldots, P_1^{-1}, P_0^{-1}$ in encoder 30 and $P_0, P_1, \ldots, P_n$ in decoder 32 can be implemented by finite precision circuits of the type shown in FIGS. 2A and 2B. FIG. 2A is conventional circuitry of an encoder for performing lossless matrixing via primitive matrices implemented with finite precision arithmetic. FIG. 2B is conventional circuitry of a decoder for performing lossless matrixing via primitive matrices implemented with finite precision arithmetic. Details of typical implementations of the FIG. 2A and FIG. 2B circuitry (and variations thereon) are described in above-cited U.S. Pat. No. 6,611,212, issued Aug. 26, 2003.

In FIG. 2A (representing circuitry for encoding a four channel audio program comprising channels S1, S2, S3, and S4), a first primitive matrix $P_0^{-1}$ (having one row of four non-zero α coefficients) operates on each sample of channel S1 (to generate encoded channel S1') by mixing the relevant sample of channel S1 with corresponding samples (occurring at the same time, t) of channels S2, S3, and S4. A second primitive matrix $P_1^{-1}$ (also having one row of four non-zero α coefficients) operates on each sample of channel S2 (to generate a corresponding sample of encoded channel S2') by mixing the relevant sample of channel S2 with corresponding samples of channels S1', S3, and S4. More specifically, the sample of channel S2 is multiplied by the inverse of a coefficient $\alpha_1$ (identified as "coeff[1,2]") of matrix $P_0^{-1}$, the sample of channel S3 is multiplied by the inverse of a coefficient $\alpha_2$ (identified as "coeff[1,3]") of matrix $P_0^{-1}$, and the sample of channel S4 is multiplied by the inverse of a coefficient $\alpha_3$ (identified as "coeff[1,4]") of matrix $P_0^{-1}$, the products are summed and then quantized, and the quantized sum is then subtracted from the corresponding sample of channel S1. Similarly, the sample of channel S1 is multiplied by the inverse of a coefficient $\alpha_0$ (identified as "coeff[2,1]") of matrix $P_1^{-1}$, the sample of channel S3 is multiplied by the inverse of a coefficient $\alpha_2$ (identified as "coeff[2,3]") of matrix $P_1^{-1}$, and the sample of channel S4 is multiplied by the inverse of a coefficient $\alpha_3$ (identified as "coeff[2,4]") of matrix $P_1^{-1}$, the products are summed and then quantized, and the quantized sum is then subtracted from the corresponding sample of channel S2. Quantization stage Q1 of matrix $P_0^{-1}$ quantizes the output of the summation element which sums the products of the multiplications (by non-zero α coefficients of the matrix $P_0^{-1}$, which are typically fractional values) to generate the quantized value which is subtracted from the sample of channel S1 to generate the corresponding sample of encoded channel S1'. Quantization stage Q2 of matrix $P_1^{-1}$ quantizes the output of the summation element which sums the products of the multiplications (by non-zero α coefficients of the matrix $P_1^{-1}$, which are typically fractional values) to generate the quantized value which is subtracted from the sample of channel S2 to generate the corresponding sample of encoded channel S2'. In a typical implementation (e.g., for performing TrueHD encoding), each sample of each of channels S1, S2, S3, and S4 comprises 24 bits (as indicated in FIG. 2A), and the output of each multiplication element comprises 38 bits (as also indicated in FIG. 2A), and each of quantization stages Q1 and Q2 outputs a 24 bit quantized value in response to each 38-bit value which is input thereto.

Of course, to encode channels S3 and S4, two additional primitive matrices could be cascaded with the two primitive matrices ($P_0^{-1}$ and $P_1^{-1}$) indicated in FIG. 2A.

In FIG. 2B (representing circuitry for decoding of the four-channel encoded program generated by the encoder of FIG. 2A), a primitive matrix $P_1$ (having one row of four non-zero $\alpha$ coefficients, and which is the inverse of the matrix $P_1^{-1}$) operates on each sample of encoded channel S2' (to generate a corresponding sample of decoded channel S2) by mixing samples of channels S1', S3, and S4 with the relevant sample of channel S2'. A second primitive matrix $P_0$ (also having one row of four non-zero $\alpha$ coefficients, and which is the inverse of the matrix $P_0^{-1}$)) operates on each sample of encoded channel S1' (to generate a corresponding sample of decoded channel S1) by mixing samples of channels S2, S3, and S4 with the relevant sample of channel S1'. More specifically, the sample of channel S1' is multiplied by a coefficient $\alpha_0$ (identified as "coeff[2,1]") of matrix $P_1$, the sample of channel S3 is multiplied by a coefficient $\alpha_2$ (identified as "coeff[2,3]") of matrix $P_1$, and the sample of channel S4 is multiplied by a coefficient $\alpha_3$ (identified as "coeff[2,4]") of matrix $P_1$, the products are summed and then quantized, and the quantized sum is then added to the corresponding sample of channel S1'. Similarly, the sample of channel S2' is multiplied by a coefficient $\alpha_1$ (identified as "coeff[1,2]") of matrix $P_0$, the sample of channel S3 is multiplied by a coefficient $\alpha_2$ (identified as "coeff[1,3]") of matrix $P_0$, and the sample of channel S4 is multiplied by a coefficient $\alpha_3$ (identified as "coeff[1,4]") of matrix $P_0$, the products are summed and then quantized, and the quantized sum is then added to the corresponding sample of channel S1'. Quantization stage Q2 of matrix $P_1$ quantizes the output of the summation element which sums the products of the multiplications (by non-zero a coefficients of the matrix $P_1$, which are typically fractional values) to generate the quantized value which is added to the sample of channel S2' to generate the corresponding sample of decoded channel S2. Quantization stage Q1 of matrix $P_0$ quantizes the output of the summation element which sums the products of the multiplications (by non-zero a coefficients of the matrix $P_0$, which are typically fractional values) to generate the quantized value which is added to the sample of channel S1' to generate the corresponding sample of decoded channel S1. In a typical implementation (e.g., for performing TrueHD decoding), each sample of each of channels S1', S2', S3, and S4 comprises 24 bits (as indicated in FIG. 2B), and the output of each multiplication element comprises 38 bits (as also indicated in FIG. 2B), and each of quantization stages Q1 and Q2 outputs a 24 bit quantized value in response to each 38-bit value which is input thereto.

Of course, to decode channels S3 and S4, two additional primitive matrices could be cascaded with the two primitive matrices ($P_0$ and $P_1$) indicated in FIG. 2B.

A sequence of primitive matrices, e.g., the sequence of primitive N×N matrices $P_0, P_1, \ldots, P_n$ implemented by the decoder of FIG. 1, operating on a vector (N samples, each of which is a sample of a different channel of a first set of N channels) can implement any linear transformation of the N samples into a new set of N samples (e.g., it can implement the linear transformation performed at a time t by multiplying samples of N channels of an object-based audio program by any N×N implementation of matrix A(t) of equation (1) during rendering of the channels into N speaker feeds, where the transformation is achieved by manipulating one channel at a time). Thus, multiplication of a set of N audio samples by a sequence of N×N primitive matrices represents a generic set of scenarios in which the set of N samples is converted to another set (of N samples) by linear operations.

With reference again to a TrueHD implementation of decoder 32 of FIG. 1, in order to maintain uniformity of decoder architecture in TrueHD, the output matrices of the downmix substream ($P_0^2$, $P_1^2$ in FIG. 1) are also implemented as primitive matrices although they need not be invertible (or have a unit diagonal) since they are not associated with achieving losslessness.

The input and output primitive matrices employed in a TrueHD encoder and decoder depend on each particular downmix specification to be implemented. The function of a TrueHD decoder is to apply the appropriate cascade of primitive matrices to the received encoded audio bitstream. Thus, the TrueHD decoder of FIG. 1 decodes the 8 channels of the encoded bitstream (delivered by system D), and generates a 2-channel downmix by applying a cascade of two output primitive matrices $P_0^2$, $P_1^2$ to a subset of the channels of the decoded bitstream. A TrueHD implementation of decoder 32 of FIG. 1 is also operable to decode the 8 channels of the encoded bitstream (delivered by system D) to recover losslessly the original 8-channel program by applying a cascade of eight output primitive matrices $P_0$, $P_1, \ldots, P_n$ to the channels of the encoded bitstream.

A TrueHD decoder does not have the original audio (which was input to the encoder) to check against to determine whether its reproduction is lossless (or as otherwise desired by the encoder in the case of a downmix). However, the encoded bitstream contains a "check word" (or lossless check) which is compared against a similar word derived at the decoder from the reproduced audio to determine whether the reproduction is faithful.

If an object-based audio program (e.g., comprising more than eight channels) were encoded by a conventional TrueHD encoder, the encoder might generate downmix substreams which carry presentations compatible with legacy playback devices (e.g., presentations which could be decoded to downmixed speaker feeds for playback on a traditional 7.1 channel or 5.1 channel or other traditional speaker set up) and a top substream (indicative of all channels of the input program). A TrueHD decoder might recover the original object-based audio program losslessly for rendering by a playback system. Each rendering matrix specification employed by the encoder in this case (i.e., for generating the top substream and each downmix substream), and thus each output matrix determined by the encoder, might be a time-varying rendering matrix, A(t), which linearly transforms samples of channels of the program (e.g., to generate a 7.1 channel or 5.1 channel downmix). However, such a matrix A(t) would typically vary rapidly in time as objects move around in the spatial scene, and bit-rate and processing limitations of a conventional TrueHD system (or other conventional decoding system) would typically constrain the system to be able at most accommodate a piecewise constant approximation to such a continuously (and rapidly) varying matrix specification (with a higher matrix update rate achieved at the cost of increased bit-rate for transmission of the encoded program). In order to support rendering of object-based multichannel audio programs (and other multichannel audio programs) with speaker feeds indicative of a rapidly varying mix of content from channels of the programs, the inventors have recognized that it is desirable to enhance conventional systems to accommodate interpolated matrixing, where rendering matrix updates are infrequent and a desired trajectory (i.e., a desired sequence of mixes of content of channels of the program) between updates is specified parametrically.

BRIEF DESCRIPTION OF THE INVENTION

In a class of embodiments, the invention is a method for encoding an N-channel audio program (e.g., an object-based audio program), wherein the program is specified over a time interval, the time interval includes a subinterval from a time t1 to a time t2, and a time-varying mix, A(t), of N encoded signal channels to M output channels (e.g., channels which correspond to playback speaker channels) has been specified over the time interval, where M is less than or equal to N, said method including steps of:

determining a first cascade of N×N primitive matrices which, when applied to samples of the N encoded signal channels, implements a first mix of audio content of the N encoded signal channels to the M output channels, wherein the first mix is consistent with the time-varying mix, A(t), in the sense that the first mix is at least substantially equal to A (t1);

determining interpolation values which, with the first cascade of primitive matrices and an interpolation function defined over the subinterval, are indicative of a sequence of cascades of N×N updated primitive matrices, such that each of the cascades of updated primitive matrices, when applied to samples of the N encoded signal channels, implements an updated mix, associated with a different time in the subinterval, of the N encoded signal channels to the M output channels, wherein each said updated mix is consistent with the time-varying mix, A(t) (preferably, the updated mix associated with any time t3 in the subinterval is at least substantially equal to A(t3), but in some embodiments there may be error between the updated mix associated with at least one time in the subinterval and the value of A(t) at such time); and generating an encoded bitstream which is indicative of encoded audio content, the interpolation values, and the first cascade of primitive matrices.

In some embodiments, the method includes a step of generating encoded audio content by performing matrix operations on samples of the program's N channels (e.g., including by applying a sequence of matrix cascades to the samples, wherein each matrix cascade in the sequence is a cascade of primitive matrices, and the sequence of matrix cascades includes a first inverse matrix cascade which is a cascade of inverses of the primitive matrices of the first cascade).

In some embodiments, each of the primitive matrices is a unit primitive matrix. In some embodiments in which N=M, the method also includes a step of losslessly recovering the N channels of the program by processing the encoded bitstream, including by performing interpolation to determine the sequence of cascades of N×N updated primitive matrices, from the interpolation values, the first cascade of primitive matrices, and the interpolation function. The encoded bitstream may be indicative of (i.e., may include data indicative of) the interpolation function, or the interpolation function may be provided otherwise to the decoder. In some embodiments in which N=M, the method also includes steps of: delivering the encoded bitstream to a decoder configured to implement the interpolation function, and processing the encoded bitstream in the decoder to losslessly recover the N channels of the program, including by performing interpolation to determine the sequence of cascades of N×N updated primitive matrices, from the interpolation values, the first cascade of primitive matrices, and the interpolation function.

In some embodiments, the program is an object-based audio program including at least one object channel and position data indicative of a trajectory of at least one object. The time-varying mix, A(t), may be determined from the position data (or from data including the position data).

In some embodiments, the first cascade of primitive matrices is a seed primitive matrix, and the interpolation values are indicative of a seed delta matrix for the seed primitive matrix.

In some embodiments, a time-varying downmix, $A_2(t)$, of audio content or encoded content of the program to M1 speaker channels has also been specified over the time interval, where M1 is an integer less than M, and the method includes steps of:

determining a second cascade of M1×M1 primitive matrices which, when applied to samples of M1 channels of the audio content or encoded content, implements a downmix of audio content of the program to the M1 speaker channels, wherein the downmix is consistent with the time-varying mix, $A_2(t)$, in the sense that the downmix is at least substantially equal to $A_2(t1)$;

determining additional interpolation values which, with the second cascade of M1×M1 primitive matrices and a second interpolation function defined over the subinterval, are indicative of a sequence of cascades of updated M1×M1 primitive matrices, such that each of the cascades of updated M1×M1 primitive matrices, when applied to samples of the M1 channels of the audio content or the encoded content, implements an updated downmix, associated with a different time in the subinterval, of audio content of the program to the M1 speaker channels, wherein each said updated downmix is consistent with the time-varying mix, $A_2(t)$, and wherein the encoded bitstream is indicative of the additional interpolation values and the second cascade of M1×M1 primitive matrices. The encoded bitstream may be indicative of (i.e., may include data indicative of) the second interpolation function, or the second interpolation function may be provided otherwise to the decoder. The time-varying downmix, $A_2(t)$, is a downmix of audio content or encoded content of the program in the sense that it is a downmix of audio content of the original program, or of the encoded audio content of the encoded bitstream, or of a partially decoded version of the encoded audio content of the encoded bitstream, or of otherwise encoded (e.g., partially decoded) audio indicative of audio content of the program. Time-variation in the downmix specification $A_2(t)$ may be due (at least in part) to ramp up to or release from clip-protection of the specified downmix.

In a second class of embodiments, the invention is a method for recovery of M channels of a multichannel audio program (e.g., an object-based audio program), wherein the program is specified over a time interval, the time interval includes a subinterval from a time t1 to a time t2, and a time-varying mix, A(t), of N encoded signal channels to M output channels has been specified over the time interval, said method including steps of: obtaining an encoded bitstream which is indicative of encoded audio content, interpolation values, and a first cascade of N×N primitive matrices; and performing interpolation to determine a sequence of cascades of N×N updated primitive matrices, from the interpolation values, the first cascade of primitive matrices, and an interpolation function over the subinterval, wherein the first cascade of N×N primitive matrices, when applied to samples of N encoded signal channels of the encoded audio content, implements a first mix of audio content of the N encoded signal channels to the M output channels, wherein the first mix is consistent with the time-varying mix, A(t), in the sense that the first mix is at least substantially equal to A(t1), and the interpolation values, with the first cascade of primitive matrices, and the interpolation function, are indicative of a sequence of cascades of N×N updated primitive matrices, such that each of the cascades of updated primitive matrices, when applied to samples of the N encoded signal channels of the encoded audio content, implements an updated mix, associated with a different time in the subinterval, of the N encoded signal channels to the M output channels, wherein each said updated mix is consistent with the time-varying mix, A(t) (preferably, the updated mix associated with any time t3 in the subinterval is at least substantially equal to A(t3), but in some embodiments there may be error between the updated mix associated with at least one time in the subinterval and the value of A(t) at such time).

In some embodiments, the encoded audio content has been generated by performing matrix operations on samples of the program's N channels, including by applying a sequence of matrix cascades to the samples, wherein each matrix cascade in the sequence is a cascade of primitive matrices, and the sequence of matrix cascades includes a first inverse matrix cascade which is a cascade of inverses of the primitive matrices of the first cascade.

The channels of the audio program that are recovered (e.g., losslessly recovered) in accordance with these embodiments from the encoded bitstream may be an downmix of audio content of an X-channel input audio program (where X is an arbitrary integer and N is less than X) which has been generated from the X-channel input audio program by performing matrix operations on the X-channel input audio program, thereby determining the encoded audio content of the encoded bitstream.

In some embodiments in the second class, each of the primitive matrices is a unit primitive matrix.

In some embodiments in the second class, a time-varying downmix, $A_2(t)$, of the N-channel program to M1 speaker channels has been specified over the time interval, and a time-varying downmix, A2(t), of audio content or encoded content of the program to M speaker channels has also been specified over the time interval. The method includes steps of:

receiving a second cascade of M1×M1 primitive matrices and second set of interpolation values;

applying the second cascade of M1×M1 primitive matrices to samples of M1 channels of the encoded audio content to implement a downmix of the N-channel program to M1 speaker channels, wherein the downmix is consistent with the time-varying mix, $A_2(t)$, in the sense that the downmix is at least substantially equal to $A_2(t1)$;

applying the second set of interpolation values, the second cascade of M1×M1 primitive matrices and a second interpolation function defined over the subinterval to obtain a sequence of cascades of updated M1×M1 primitive matrices; and applying the updated M1×M1 primitive matrices to samples of the M1 channels of the encoded content to implement at least one updated downmix of the N-channel program, associated with a different time in the subinterval, wherein each said updated downmix is consistent with the time-varying mix, $A_2(t)$.

In some embodiments the invention is a method for rendering a multichannel audio program, including steps of providing a seed matrix set (e.g., a single seed matrix, or a set of at least two seed matrices, corresponding to a time during the audio program) to a decoder, and performing interpolation on the seed matrix set (which is associated with a time during the audio program) to determine an interpolated rendering matrix set (a single interpolated rendering matrix, or a set of at least two interpolated rendering matrices, corresponding to a later time during the audio program) for use in rendering channels of the program.

In some embodiments, a seed primitive matrix and a seed delta matrix (or a set of seed primitive matrices and seed delta matrices) are delivered from time to time (e.g., infrequently) to the decoder. The decoder updates each seed primitive matrix (corresponding to a time, t1) by generating an interpolated primitive matrix (for a time, t, later than t1) in accordance with an embodiment of the invention from the seed primitive matrix and a corresponding seed delta matrix, and an interpolation function f(t). Data indicative of the interpolation function may be delivered with the seed matrices or the interpolation function may be predetermined (i.e., known in advance by both the encoder and decoder). Alternatively, a seed primitive matrix (or a set of seed primitive matrices) is delivered from time to time (e.g., infrequently) to the decoder. The decoder updates each seed primitive matrix (corresponding to a time, t1) by generating an interpolated primitive matrix (for a time, t, later than t1) in accordance with an embodiment of the invention from the seed primitive matrix and an interpolation function f(t), i.e., not necessarily using a seed delta matrix which corresponds to the seed primitive matrix. Data indicative of the interpolation function may be delivered to with the seed primitive matrix (or matrices) or the function may be predetermined (i.e., known in advance by both the encoder and decoder). In typical embodiments, each primitive matrix is a unit primitive matrix. In this case, the inverse of the primitive matrix is simply determined by inverting (multiplying by −1) each of its non-trivial coefficients (each of its a coefficients). This enables the inverses of the primitive matrices (which are applied by the encoder to encode the bitstream) to be determined more efficiently, and allows use of finite precision processing (e.g., finite precision circuits) to implement the required matrix multiplications in the encoder and decoder.

Aspects of the invention include a system or device (e.g., an encoder or decoder) configured (e.g., programmed) to implement any embodiment of the inventive method, a system or device including a buffer which stores (e.g., in a non-transitory manner) at least one frame or other segment of an encoded audio program generated by any embodiment of the inventive method or steps thereof, and a computer readable medium (e.g., a disc) which stores code (e.g., in a non-transitory manner) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

NOTATION AND NOMENCLATURE

Figure 1:
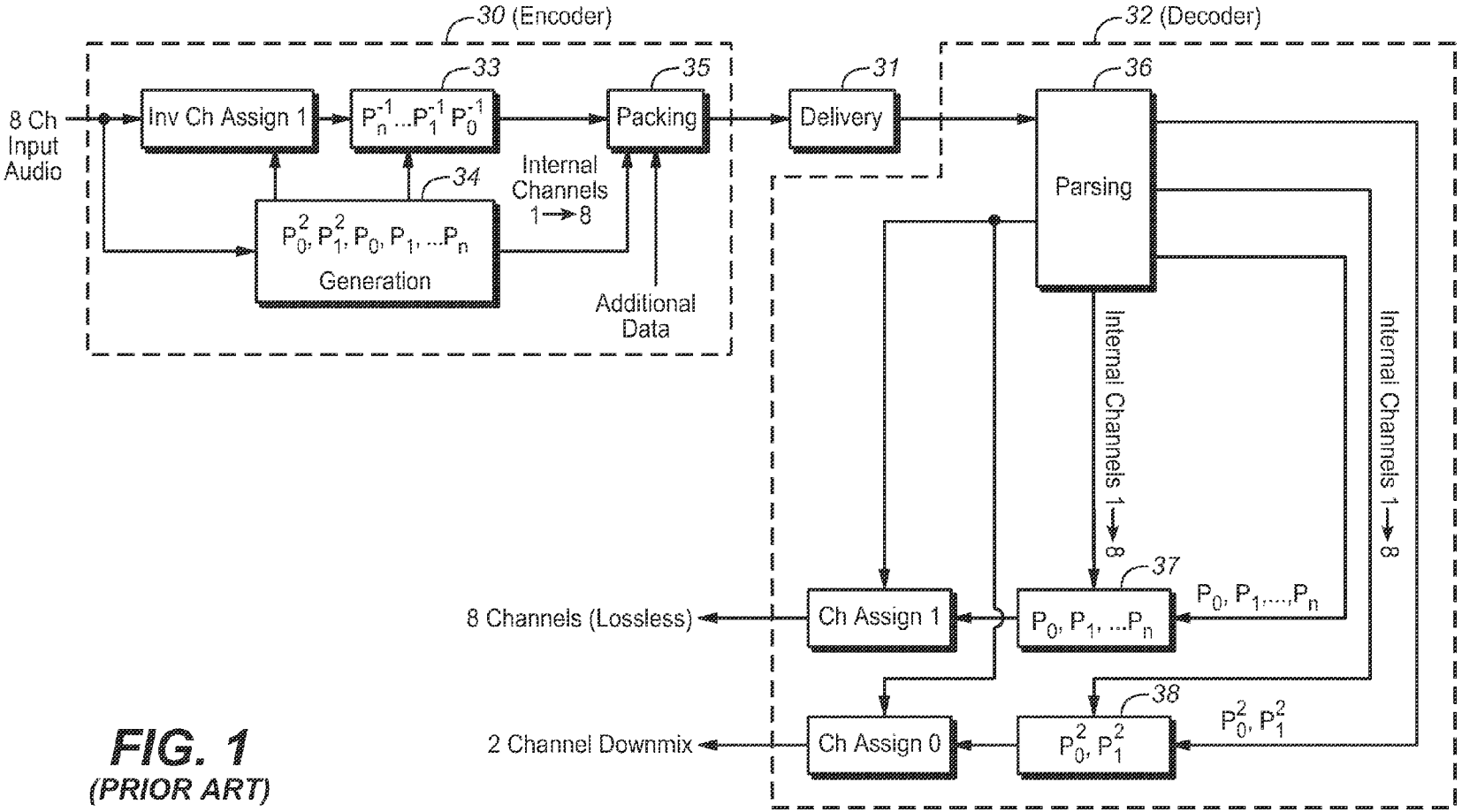
FIG. 1 (PRIOR ART)
FIG. 1 is a block diagram of elements of a conventional system including an encoder, a delivery subsystem, and a decoder.
Figure 2A:
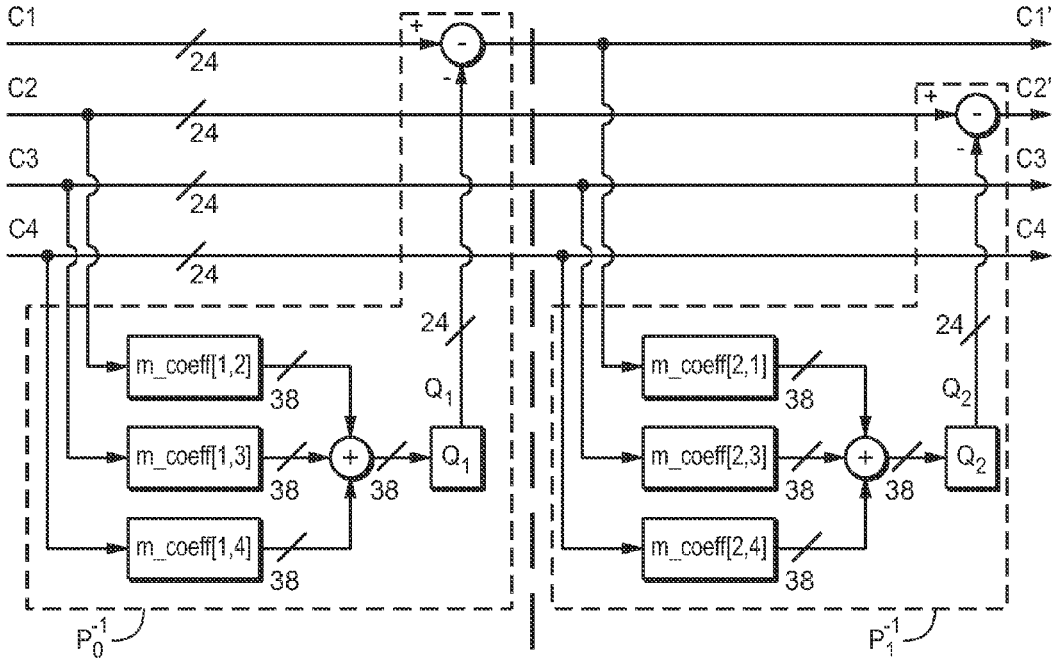
FIG. 2A (PRIOR ART)
FIG. 2A is a diagram of conventional encoder circuitry for performing lossless matrixing operations via primitive matrices implemented with finite precision arithmetic.
Figure 2B:
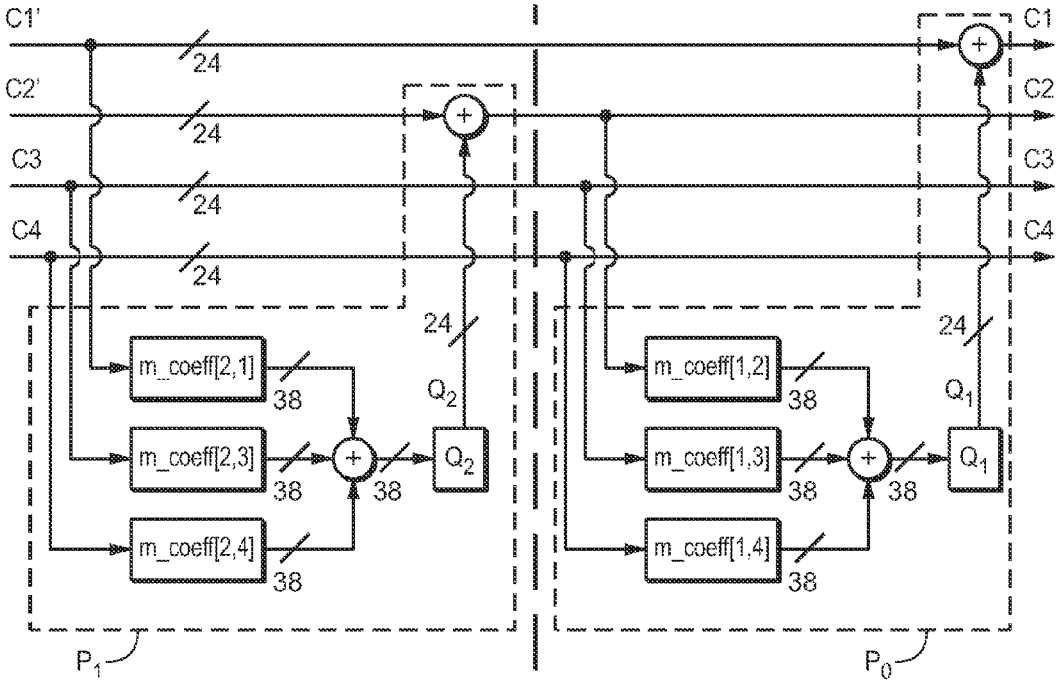
FIG. 2B (PRIOR ART)
FIG. 2B is a diagram of conventional decoder circuitry for performing lossless matrixing operations via primitive matrices implemented with finite precision arithmetic.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates Y output signals in response to multiple inputs, in which the subsystem generates M of the inputs and the other Y-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source; and object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel).

DETAILED DESCRIPTION OF EMBODIMENTS OF THE INVENTION

Examples of embodiments of the invention will be described with reference to FIGS. 3, 4, 5, and 6.

Figure 5:
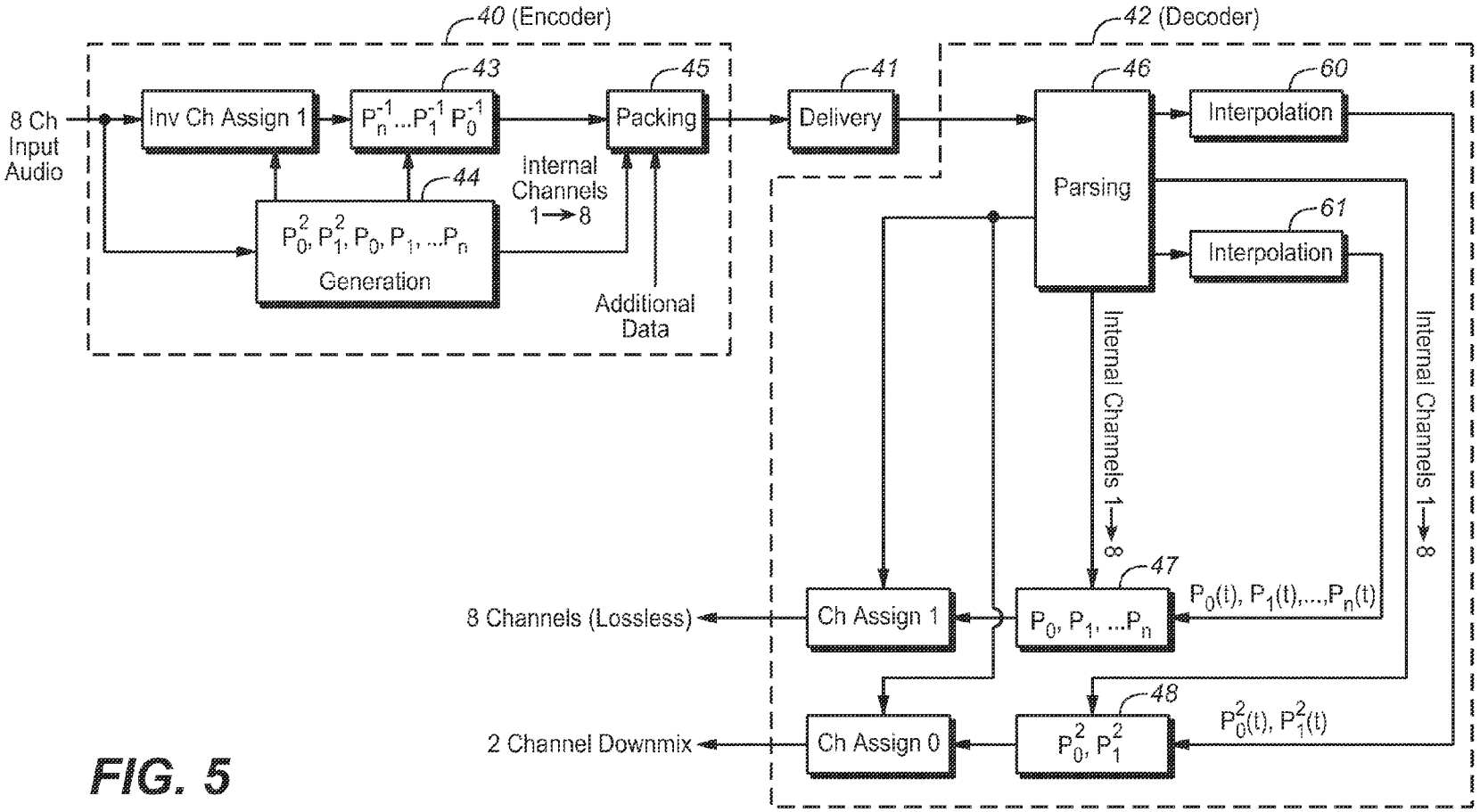
FIG. 5 is a block diagram of an embodiment of the inventive system including an embodiment of the inventive encoder, a delivery subsystem, and an embodiment of the inventive decoder.

FIG. 5 is a block diagram of an embodiment of the inventive audio data processing system which includes encoder 40 (an embodiment of the inventive encoder), delivery subsystem 41 (which may be identical to delivery subsystem 31 of FIG. 1), and decoder 42 (an embodiment of the inventive decoder), coupled together as shown. Although subsystem 42 is referred to herein as a "decoder" it should be understood that may be implemented as a playback system including a decoding subsystem (configured to parse and decode a bitstream indicative of an encoded multichannel audio program) and other subsystems configured to implement rendering and at least some steps of playback of the decoding subsystem's output. Some embodiments of the invention are decoders which are not configured to perform rendering and/or playback (and which would typically be used with a separate rendering and/or playback system). Some embodiments of the invention are playback systems (e.g., a playback system including a decoding subsystem and other subsystems configured to implement rendering and at least some steps of playback of the decoding subsystem's output.

In the FIG. 5 system, encoder 40 is configured to encode an 8-channel audio program (e.g., a traditional set of 7.1 speaker feeds) as an encoded bitstream including two substreams, and decoder 42 is configured to decode the encoded bitstream to render either the original 8-channel program (losslessly) or a 2-channel downmix of the original 8-channel program. Encoder 40 is coupled and configured to generate the encoded bitstream and to assert the encoded bitstream to delivery system 41.

Delivery system 41 is coupled and configured to deliver (e.g., by storing and/or transmitting) the encoded bitstream to decoder 42. In some embodiments, system 41 implements delivery of (e.g., transmits) an encoded multichannel audio program over a broadcast system or a network (e.g., the internet) to decoder 42. In some embodiments, system 41 stores an encoded multichannel audio program in a storage medium (e.g., a disk or set of disks), and decoder 42 is configured to read the program from the storage medium.

The block labeled "InvChAssign1" in encoder 40 is configured to perform channel permutation (equivalent to multiplication by a permutation matrix) on the channels of the input program. The permutated channels then undergo encoding in stage 43, which outputs eight encoded signal channels. The encoded signal channels may (but need not) correspond to playback speaker channels. The encoded signal channels are sometimes referred to as "internal" channels since a decoder (and/or rendering system) typically decodes and renders the content of the encoded signal channels to recover the input audio, so that the encoded signal channels are "internal" to the encoding/decoding system. The encoding performed in stage 43 is equivalent to multiplication of each set of samples of the permutated channels by an encoding matrix (implemented as a cascade of matrix multiplications, identified as $P_n^{-1}, \ldots, P_1^{-1}, P_0^{-1}$.

Although n may be equal to 7 in the exemplary embodiment, in the embodiment and in variations thereon the input audio program comprises an arbitrary number (N or X) channels, where N (or X) is any integer greater than one, and n in FIG. 5 may be n=N−1 (or n=X−1 or another value). In such alternative embodiments, the encoder is configured to encode the multichannel audio program as an encoded bitstream including some number of substreams, and the decoder is configured to decode the encoded bitstream to render either the original multichannel program (losslessly) or one or more downmixes of the original multichannel program. For example, the encoding stage (corresponding to stage 43) of such an alternative embodiment may apply a cascade of N×N primitive matrices to samples of the program's channels, to generate N encoded signal channels that can be converted to a first mix of M output channels, wherein the first mix is consistent with a time-varying mix A(t), specified over an interval, in the sense that the first mix is at least substantially equal to A(t1), where t1 is a time in the interval. The decoder may create the M output channels by applying a cascade of N×N primitive matrices received as part of the encoded audio content. The encoder in such an alternative embodiment may also generate a second cascade of M1×M1 primitive matrices (where M1 is an integer less than N), which is also included in the encoded audio content. A decoder may apply the second cascade on M1 encoded signal channels to implement a downmix of the N-channel program to M1 speaker channels, wherein the downmix is consistent with another time varying mix, $A_2(t)$, in the sense that the downmix is at least substantially equal to $A_2(t1)$. The encoder in such an alternative embodiment would also generate interpolation values (in accordance with any embodiment of the present invention) and include the interpolation values in the encoded bitstream output from the encoder, for use by a decoder to decode and render content of the encoded bitstream in accordance with the time-varying mix, A(t), and/or to decode and render a downmix of content of the encoded bitstream in accordance with the time-varying mix, $A_2(t)$.

The description of FIG. 5 will sometimes refer to the multichannel signal input to the inventive encoder as an 8-channel input signal for specificity, but the description (with trivial variations apparent to those of ordinary skill) also applies to the general case by replacing references to an 8-channel input signal with references to an N-channel input signal, replacing references to cascades of 8-channel (or 2-channel) primitive matrices with references to M-channel (or M1-channel) primitive matrices, and replacing references to lossless recovery of an 8-channel input signal to references to lossless recovery of an M-channel audio signal (where the M-channel audio signal has been determined by performing matrix operations to apply a time-varying mix, A(t), to an N-channel input audio signal to determine M encoded signal channels).

With reference to encoder stage 43 of FIG. 5, each matrix $P_n^{-1}, \ldots, P_1^{-1}$, and $P_0^{-1}$ (and thus the cascade applied by stage 43) is determined in subsystem 44, and is updated from time to time (typically infrequently) in accordance with a specified time-varying mix of the program's N (where N=8) channels to N encoded signal channels which has been specified over the time interval.

Matrix determination subsystem 44 is configured to generate data indicative of the coefficients of two sets of output matrices (one set corresponding to each of two substreams of the encoded channels). Each set of output matrices is updated from time to time, so that the coefficients are also updated from time to time. One set of output matrices consists of two rendering matrices, $P_0^2(t)$, $P_1^2(t)$, each of which is a primitive matrix (preferably a unit primitive matrix) of dimension 2×2, and is for rendering a first substream (a downmix substream) comprising two of the encoded audio channels of the encoded bitstream (to render a two-channel downmix of the eight-channel input audio). The other set of output matrices consists of eight rendering matrices, $P_0(t), P_1(t), \ldots, P_n(t)$, each of which is a primitive matrix (preferably a unit primitive matrix) of dimension 8×8, and is for rendering a second substream comprising all eight of the encoded audio channels of the encoded bitstream (for lossless recovery of the eight-channel input audio program). For each time, t, a cascade of the rendering matrices, $P_0^2(t)$, $P_1^2(t)$, can be interpreted as a rendering matrix for the channels of the first substream that renders the two channel downmix from the two encoded signal channels in the first substream, and similarly a cascade of the rendering matrices, $P_0(t), P_1(t), \ldots, P_n(t)$, can be interpreted as a rendering matrix for the channels of the second substream.

The coefficients (of each rendering matrix) that are output from subsystem 44 to packing subsystem 45 are metadata indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker.

The eight encoded audio channels (output from encoding stage 43), the output matrix coefficients (generated by subsystem 44), and typically also additional data are asserted to packing subsystem 45, which assembles them into the encoded bitstream which is then asserted to delivery system 41.

The encoded bitstream includes data indicative of the eight encoded audio channels, the two sets of time-varying output matrices (one set corresponding to each of two substreams of the encoded channels), and typically also additional data (e.g., metadata regarding the audio content).

Figure 6:
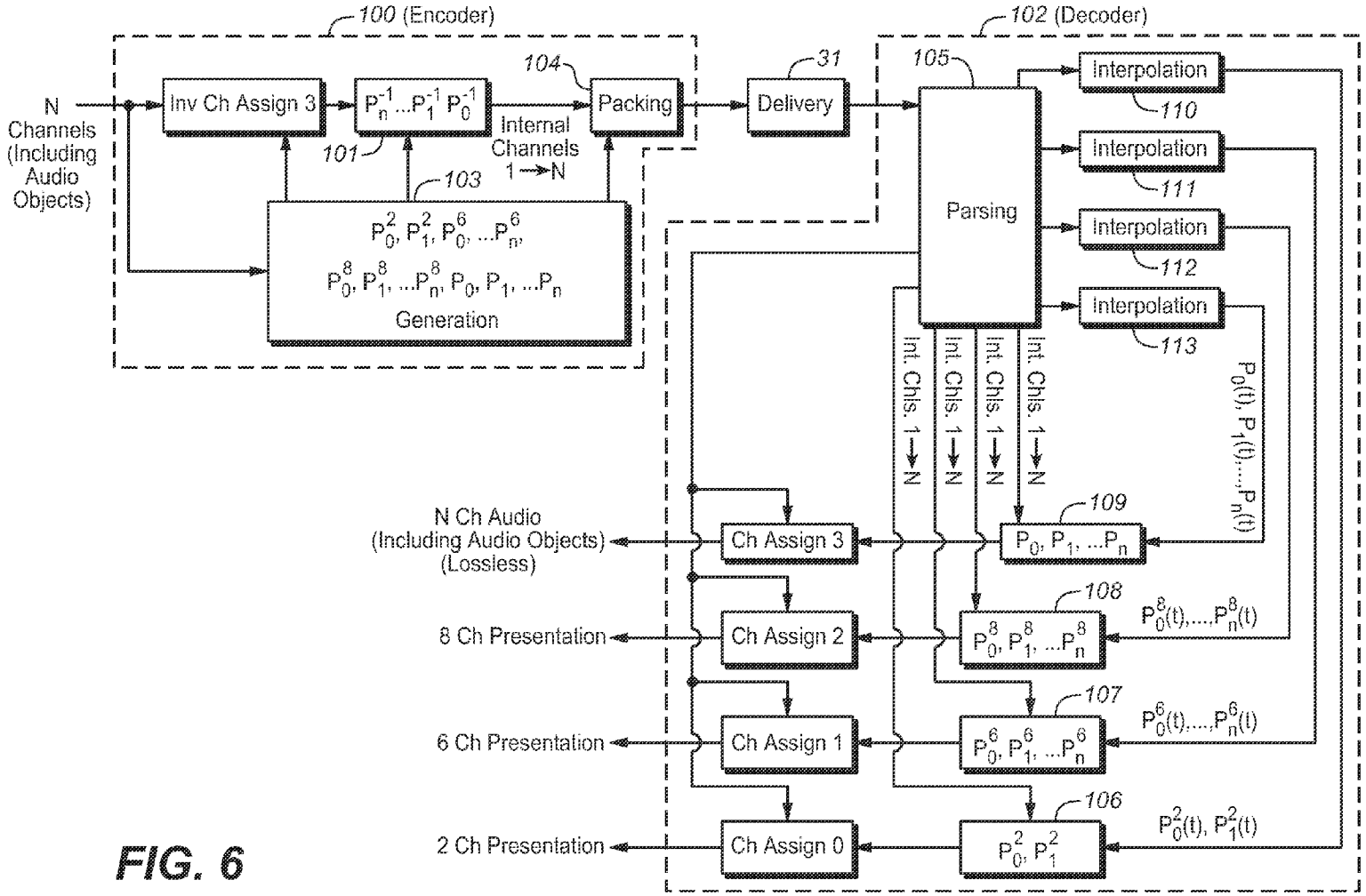
FIG. 6 is a block diagram of another embodiment of the inventive system including an embodiment of the inventive encoder, a delivery subsystem, and an embodiment of the inventive decoder.

In operation, encoder 40 (and alternative embodiments of the inventive encoder, e.g., encoder 100 of FIG. 6) encodes an N-channel audio program whose samples correspond to a time interval, where the time interval includes a subinterval from a time t1 to a time t2. When a time-varying mix, A(t), of N encoded signal channels to M output channels has been specified over the time interval, the encoder performs steps of:

determining a first cascade of N×N primitive matrices (e.g., matrices $P_0(t1), P_1(t1), \ldots, P_n(t1)$, for the time t1) which, when applied to samples of the N encoded signal channels, implements a first mix of audio content of the N encoded signal channels to the M output channels, wherein the first mix is consistent with the time-varying mix, A(t), in the sense that the first mix is at least substantially equal to A(t1);

generating encoded audio content (e.g., the output of encoder 40's stage 43, or the output of encoder 100's stage 103) by performing matrix operations on samples of the program's N channels, including by applying a sequence of matrix cascades to the samples, wherein each matrix cascade in the sequence is a cascade of primitive matrices, and the sequence of matrix cascades includes a first inverse matrix cascade which is a cascade of inverses of the primitive matrices of the first cascade;

determining interpolation values (e.g., interpolation values included in the output of encoder 40's stage 44, or in the output of encoder 100's stage 103) which, with the first cascade of primitive matrices (e.g., included in the output of stage 44 or stage 103) and an interpolation function defined over the subinterval, are indicative of a sequence of cascades of N×N updated primitive matrices, such that each of the cascades of updated primitive matrices, when applied to samples of the N encoded signal channels, implements an updated mix, associated with a different time in the subinterval, of the N encoded signal channels to the M output channels, wherein each said updated mix is consistent with the time-varying mix, A(t). Preferably, but not necessarily (in all embodiments), each updated mix is consistent with the time-varying mix in the sense that the updated mix associated with any time t3 in the subinterval is at least substantially equal to A(t3); and generating an encoded bitstream (e.g., the output of encoder 40's stage 45 or the output of encoder 100's stage 104) which is indicative of the encoded audio content, the interpolation values, and the first cascade of primitive matrices.

With reference to stage 44 of FIG. 5, each set of output matrices (set $P_0^2$, $P_1^2$ or set $P_0, P_1, \ldots, P_n$) is updated from time to time. The first set of matrices $P_0^2$, $P_1^2$ that is output (at a first time, t1) is a seed matrix (implemented as a cascade of unit primitive matrices) which determines a linear transformation to be performed at the first time during the program (i.e., on samples of two channels of the encoded output of stage 43, corresponding to the first time). The first set of matrices $P_0, P_1, \ldots, P_n$ that is output (at first time, t1) is also seed matrix (implemented as a cascade of unit primitive matrices) which determines a linear transformation to be performed at the first time during the program (i.e., on samples of all eight channels of the encoded output of stage 43 corresponding to the first time). Each updated set of matrices $P_0^2$, $P_1^2$ that is output from stage 44 is an updated seed matrix (implemented as a cascade of unit primitive matrices, which may also be referred to as a cascade of unit seed primitive matrices) which determines a linear transformation to be performed at the update time during the program (i.e., on samples of two channels of the encoded output of stage 43, corresponding to the update time). Each updated set of matrices $P_0, P_1, \ldots, P_n$ that is output from stage 43 is also seed matrix (implemented as a cascade of unit primitive matrices, which may also be referred to as a cascade of unit seed primitive matrices) which determines a linear transformation to be performed at the update time during the program (i.e., on samples of all eight channels of the encoded output of stage 43 corresponding to the first time).

Output stage 44 also outputs interpolation values, which (with an interpolation function for each seed matrix) enable decoder 42 to generated interpolated versions of the seed matrices (corresponding to times after the first time, t1, and between the update times). The interpolation values (which may include data indicative of each interpolation function) are included by stage 45 in the encoded bitstream output from encoder 40. We will describe examples of such interpolation values below (the interpolation values may include a delta matrix for each seed matrix).

With reference to decoder 42 of FIG. 5, parsing subsystem 46 (of decoder 42) is configured to accept (read or receive) the encoded bitstream from delivery system 41 and to parse the encoded bitstream. Subsystem 46 is operable to assert the substreams of the encoded bitstream (including a "first" substream comprising only two encoded channels of the encoded bitstream), and output matrices ($P_0^2$, $P_1^2$) corresponding to the first substream, to matrix multiplication stage 48 (for processing which results in a 2-channel downmix presentation of content of the original 8-channel input program). Subsystem 46 is also operable to assert the substreams of the encoded bitstream (a "second" substream comprising all eight encoded channels of the encoded bitstream), and corresponding output matrices ($P_0, P_1, \ldots, P_n$) to matrix multiplication stage 47 for processing which results in lossless reproduction of the original 8-channel program.

Parsing subsystem 46 (and parsing subsystem 105 in FIG. 6) may include (and/or implement) additional lossless encoding and decoding tools (for example, LPC coding, Huffman coding, and so on).

Interpolation stage 60 is coupled to receive each seed matrix for the second substream (i.e., the initial set of primitive matrices, $P_0, P_1, \ldots, P_n$, for time t1, and each updated set of primitive matrices, $P_0, P_1, \ldots, P_n$) included in the encoded bitstream, and the interpolation values (also included in the encoded bitstream) for generating interpolated versions of each seed matrix. Stage 60 is coupled and configured to pass through (to stage 47) each such seed matrix, and to generate (and assert to stage 47) interpolated versions of each such seed matrix (each interpolated version corresponding to a time after the first time, t1, and before the first seed matrix update time, or between subsequent seed matrix update times).

Interpolation stage 61 is coupled to receive each seed matrix for the first substream (i.e., the initial set of primitive matrices, $P_0^2$ and $P_1^2$, for time t1, and each updated set of primitive matrices, $P_0^2$ and $P_1^2$) included in the encoded bitstream, and the interpolation values (also included in the encoded bitstream) for generating interpolated versions of each such seed matrix. Stage 61 is coupled and configured to pass through (to stage 48) each such seed matrix, and to generate (and assert to stage 48) interpolated versions of each such seed matrix (each interpolated version corresponding to a time after the first time, t1, and before the first seed matrix update time, or between subsequent seed matrix update times).

Stage 48 multiplies two audio samples of the two channels (of the encoded bitstream) which correspond to the channels of the first substream by the most recently updated cascade of the matrices $P_0^2$ and $P_1^2$ (e.g., a cascade of the most recent interpolated versions of matrices $P_0^2$ and $P_1^2$ generated by stage 61), and each resulting set of two linearly transformed samples undergoes channel permutation (equivalent to multiplication by a permutation matrix) represented by the block titled "ChAssign0" to yield each pair of samples of the required 2 channel downmix of the 8 original audio channels. The cascade of matrixing operations performed in encoder 40 and decoder 42 is equivalent to application of a downmix matrix specification that transforms the 8 input audio channels to the 2-channel downmix.

Stage 47 multiplies each vector of eight audio samples (one from each of the full set of eight channels of the encoded bitstream) by the most recently updated cascade of the matrices $P_0, P_1, \ldots, P_n$ (e.g., a cascade of the most recent interpolated versions of matrices $P_0, P_1, \ldots, P_n$ generated by stage 60) and each resulting set of eight linearly transformed samples undergoes channel permutation (equivalent to multiplication by a permutation matrix) represented by the block labeled "ChAssign1" to yield each set of eight samples of the losslessly recovered original 8-channel program. In order that the output 8 channel audio is exactly the same as the input 8 channel audio (to achieve the "lossless" characteristic of the system), the matrixing operations performed in encoder 40 should be exactly (including quantization effects) the inverse of the matrixing operations performed in decoder 42 on the second substream of the encoded bitstream (i.e., each multiplication in stage 47 of decoder 42 by a cascade of matrices $P_0, P_1, \ldots, P_n$). Thus, in FIG. 5, the matrixing operations in stage 43 of encoder 40 are identified as a cascade of the inverse matrices of the matrices $P_0, P_1, \ldots, P_n$, in the opposite sequence applied in stage 47 of decoder 42, namely: $P_n^{-1}, \ldots, P_1^{-1}, P_0^{-1}$.

Thus, stage 47 (with the permutation stage, ChAssign1) is a matrix multiplication subsystem coupled and configured to apply sequentially each cascade of primitive matrices output from interpolation stage 60 to the encoded audio content extracted from the encoded bitstream, to recover losslessly the N channels of at least a segment of the multichannel audio program that was encoded by encoder 40.

Permutation stage ChAssign1 of decoder 42 applies to the output of stage 47 the inverse of the channel permutation applied by encoder 40 (i.e., the permutation matrix represented by stage "ChAssign1" of decoder 42 is the inverse of that represented by element "InvChAssign1" of encoder 40).

In variations on subsystems 40 and 42 of the system shown in FIG. 5, one or more of the elements are omitted or additional audio data processing units are included.

In variations on the described embodiment of decoder 42, the inventive decoder is configured to perform lossless recovery of N channels of encoded audio content from an encoded bitstream indicative of N encoded signal channels, where the N channels of audio content are themselves a downmix of audio content of an X-channel input audio program (where X is an arbitrary integer and N is less than X), generated by performing matrix operations on the X-channel input audio program to apply a time-varying mix to the X channels of the input audio program, thereby determining the N channels of encoded audio content of the encoded bitstream. In such variations, the decoder performs interpolation on primitive N×N matrices provided with (e.g., included in) the encoded bitstream.

In a class of embodiments, the invention is a method for rendering a multichannel audio program, including by performing a linear transformation (matrix multiplication) on samples of channels of the program (e.g., to generate a downmix of content of the program). The linear transformation is time dependent in the sense that the linear transformation to be performed at one time during the program (i.e., on samples of the channels corresponding to that time) differs from the linear transformation to be performed at another time during the program. In some embodiments, the method employs at least one seed matrix (which may be implemented as a cascade of unit primitive matrices) which determines the linear transformation to be performed at a first time during the program (i.e., on samples of the channels corresponding to the first time), and implements interpolation to determine at least one interpolated version of the seed matrix which determines the linear transformation to be performed at a second time during the program. In typical embodiments, the method is performed by a decoder (e.g., decoder 40 of FIG. 5 or decoder 102 of FIG. 6) which is included in, or associated with, a playback system. Typically, the decoder is configured to perform lossless recovery of audio content of an encoded audio bitstream indicative of the program, and the seed matrix (and each interpolated version of the seed matrix) is implemented as a cascade of primitive matrices (e.g., unit primitive matrices).

Typically, rendering matrix updates (updates of the seed matrix) occur infrequently (e.g., a sequence of updated versions of the seed matrix is included in the encoded audio bitstream delivered to the decoder, but there are long time intervals between the segments of the program corresponding to consecutive ones of such updated versions), and a desired rendering trajectory (e.g., a desired sequence of mixes of content of channels of the program) between seed matrix updates is specified parametrically (e.g., by metadata included in the encoded audio bitstream delivered to the decoder).

Each seed matrix (of a sequence of updated seed matrices) will be denoted as $A(t_j)$, or $P_k(t_j)$ if it is a primitive matrix, where $t_j$ is the time (in the program) corresponding to the seed matrix (i.e., the time corresponding to the "j"th seed matrix). Where the seed matrix is implemented as a cascade of primitive matrices, $P_k(t_j)$, the index k indicates the position in the cascade of each primitive matrix. Typically, the "k"th matrix, $P_k(t_j)$, in a cascade of primitive matrices operates on the "k"th channel.

When the linear transformation (e.g., downmix specification), A(t), is rapidly varying, an encoder (e.g., a conventional encoder) would need to transmit updated seed matrices frequently in order to achieve a close approximation of A(t).

Consider a sequence of primitive matrices $P_k(t1)$, $P_k(t2)$, $P_k(t3)$, . . . , which operate on the same channel k but at different time instants t1, t2, t3, . . . . Rather than send updated primitive matrices at each of these instants, an embodiment inventive method sends, at time t1 (i.e., includes in an encoded bitstream in a position corresponding to time t1) a seed primitive matrix $P_k(t)$, and a seed delta matrix $\Delta_k(t1)$ that defines the rate of change of matrix coefficients. For example, the seed primitive matrix and seed delta matrix may have the form:

$$P_k(t1) = \begin{bmatrix} 1 & 0 & \ddots & \ddots & 0 \\ \ddots & 1 & \ddots & \ddots & \ddots \\ \alpha_0 & \dots & \alpha_k & \ddots & \alpha_{N-1} \\ \vdots & \ddots & \ddots & \ddots & \ddots \\ 0 & 0 & 0 & 0 & 1 \end{bmatrix}$$

$$\Delta_k(t1) = \begin{bmatrix} 0 & 0 & \ddots & \ddots & 0 \\ \ddots & 0 & \ddots & \ddots & \ddots \\ \delta_0 & \dots & \delta_k & \ddots & \delta_{N-1} \\ \vdots & \ddots & \ddots & \ddots & \ddots \\ 0 & 0 & 0 & 0 & 0 \end{bmatrix}$$

Since $P_k(t1)$ is a primitive matrix it is identical to the identity matrix of dimension N×N except for one (non-trivial) row (i.e., the row comprising elements $\alpha_0, \alpha_1, \alpha_2, \dots \alpha_{N-1}$ in the example). In the example, matrix $\Delta_k(t1)$ comprises zeros, except for one (non-trivial) row (i.e., the row comprising elements $\delta_0, \delta_1, \dots \alpha_{N-1}$ in the example). Element $\alpha_k$ denotes the one of elements $\alpha_0, \alpha_1, \alpha_2, \dots \alpha_{N-1}$ which occurs on the diagonal of $P_k(t1)$, and element $\delta_k$ denotes the one of elements $\delta_0, \delta_1, \dots \alpha_{N-1}$ which occurs on the diagonal of $\Delta_k(t1)$.

Thus, the primitive matrix at a time instant t (occurring after time t1) is interpolated (e.g., by stage 60 or 61 of decoder 42, or stage 110, 111, 112, or 113 of decoder 102) as:

$$P_k(t)=P_k(t1)+f(t)\Delta_k(t1),$$

where f(t) is the interpolation factor for time t, and f(t1)=0. For instance, if linear interpolation is desired, the function f(t) may be of the form $f(t)=\alpha*(t-t1)$, where a is a constant. If the interpolation is implemented in a decoder, the decoder must be configured to know the function f(t). For example, metadata determining the function f(t) may be delivered to the decoder with the encoded audio bitstream to be decoded and rendered.

While the above describes a general case of interpolation of primitive matrices, with element $\alpha_k$ equal to 1, $P_k(t1)$ is a unit primitive matrix which is amenable for lossless inversion. However, in order to maintain losslessness at each time instant we would need to also set $\delta_k=0$, so that the primitive matrix at each instant is amenable for lossless inversion.

Note that $P_k(t)x(t)=P_k(t1)x(t)+f(t)(\Delta_k(t1)x(t))$. Thus rather than updating the seed primitive matrix at each time instant t, one could equivalently calculate two intermediate set of channels $P_k(t1)x(t)$ and $\Delta_k(t1)x(t)$, and combine them with the interpolation factor fit). This approach is typically computationally less expensive compared to the approach of updating the primitive matrix each instant where each delta coefficient has to be multiplied by the interpolation factor.

Yet another equivalent approach is to split f(t) into an integer r and a fraction f(t)−r, and then achieve the required application of the interpolated primitive matrix as:

$$P_k(t)x(t)=(P_k(t1)+r\Delta_k(t1))x(t)+(f(t)-r)(\Delta_k(t1)x(t)). \quad (2)$$

This latter approach (using equation (2)) would thus be a mixture of the two approaches discussed earlier.

In TrueHD, 0.833 ms (40 samples at 48 kHz) worth of audio is defined as an access unit. If the delta matrix $\Delta_k$ is defined as the rate of change of the primitive matrix $P_k$ per access unit, and if we define f(t)=(t−t1)/T, where T is the length of the access unit, then r in equation (2) increases by 1 every access unit, and f(t)−r is simply a function of the offset of a sample within an access unit. Thus the fractional value f(t)−r need not necessarily be calculated and can be derived simply from a look-up table indexed by offsets within an access unit. At the end of each access unit, $P_k(t1)+r\Delta_k(t1)$ is updated by the addition of $\Delta_k(t1)$. In general T need not correspond to an access unit and may instead be any fixed segmentation of the signal, for instance, it could be a block of length 8 samples.

A further simplification, albeit an approximation, would be to ignore the fractional part f(t)−r altogether and periodically update $P_k(t1)+r\Delta_k(t1)$. This essentially yields a piece-wise constant matrix update, but without the requirement for transmitting primitive matrices often.

Figure 3:
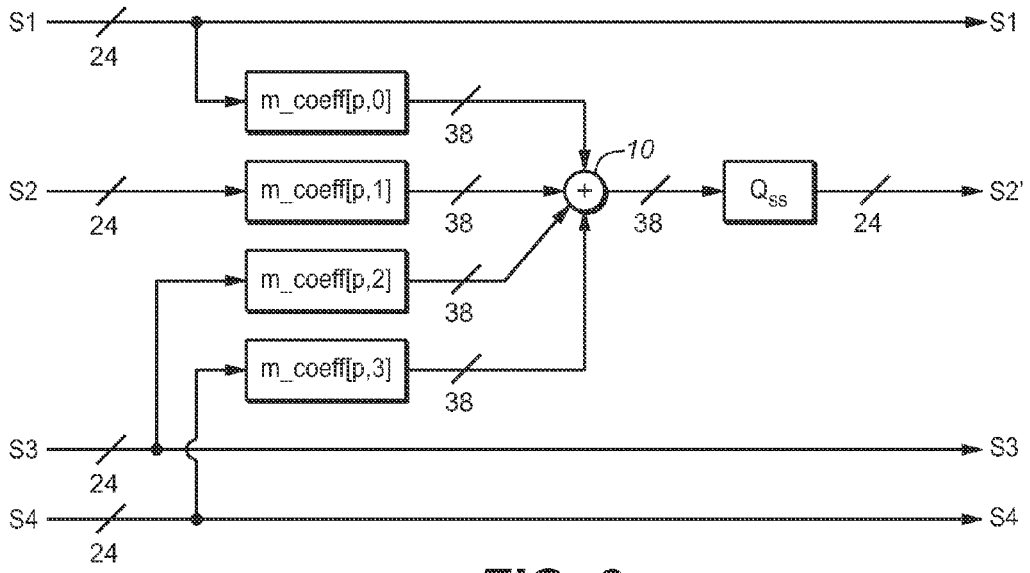
FIG. 3 is a block diagram of circuitry employed in an embodiment of the invention to apply a 4×4 primitive matrix (implemented with finite precision arithmetic) to four channels of an audio program. The primitive matrix is a seed primitive matrix, whose one non-trivial row comprises elements $\alpha 0$, $\alpha 1$, $\alpha 2$, and $\alpha 3$.

FIG. 3 is a block diagram of circuitry employed in an embodiment of the invention to apply a 4×4 primitive matrix (implemented with finite precision arithmetic) to four channels of an audio program. The primitive matrix is a seed primitive matrix, whose one non-trivial row comprises elements $\alpha_0$, $\alpha_1$, $\alpha_2$, and $\alpha_3$. It is contemplated that four such primitive matrices, each for transforming samples of a different one of the four channels, would be cascaded to transform samples of all four of the channels. Such circuitry could be used when the primitive matrices are first updated via interpolation, and the updated primitive matrices applied on the audio data.

Figure 4:
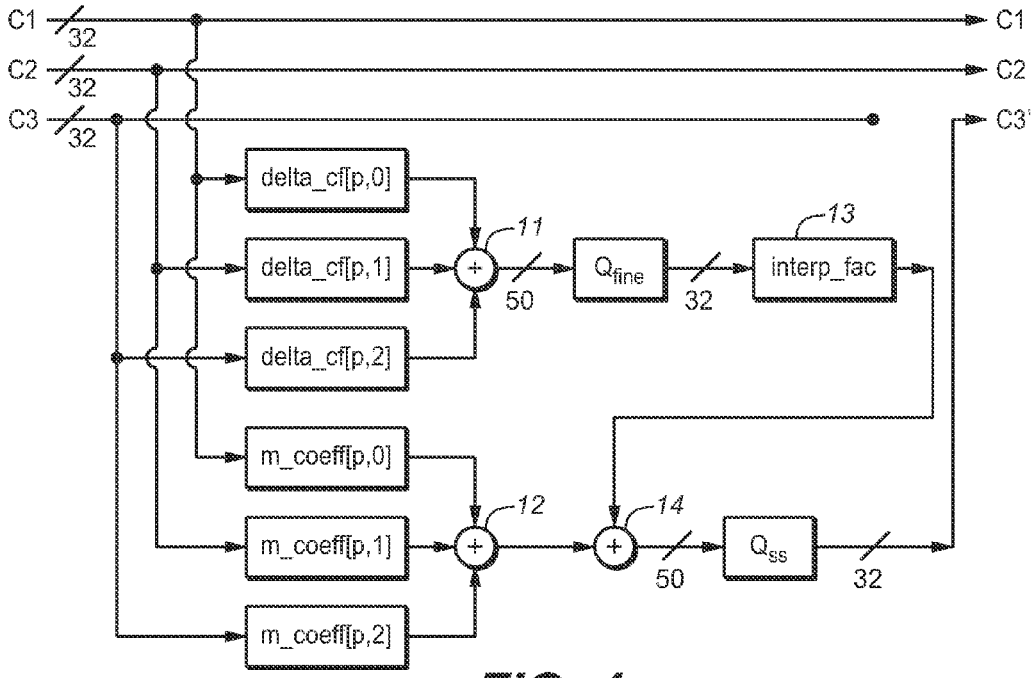
FIG. 4 is a block diagram of circuitry employed in an embodiment of the invention to apply a 3×3 primitive matrix (implemented with finite precision arithmetic) to three channels of an audio program. The primitive matrix is an interpolated primitive matrix, generated from a seed primitive matrix Pk(t1) whose one non-trivial row comprises elements $\alpha 0$, $\alpha 1$, and $\alpha 2$, and a seed delta matrix $\Delta_k(t1)$ whose the non-trivial row comprising elements $\delta 0$, $\delta 1$, . . . , $\delta N-1$, and an interpolation function f(t).

FIG. 4 is a block diagram of circuitry employed in an embodiment of the invention to apply a 3×3 primitive matrix (implemented with finite precision arithmetic) to three channels of an audio program. The primitive matrix is an interpolated primitive matrix, generated in accordance with an embodiment of the invention from a seed primitive matrix $P_k(t1)$ whose one non-trivial row comprises elements $\alpha_0$, $\alpha_1$, and $\alpha_2$ and a seed delta matrix $\Delta_k(t1)$ whose the non-trivial row comprising elements $\delta_0$, $\delta_1$, and $\delta_2$ and an interpolation function f(t). Thus, the primitive matrix at a time instant t (occurring after time t1) is interpolated as: $P_k(t)=P_k(t1)+f(t)\Delta_k(t1)$, where f(t) is an interpolation factor for time t (the value of interpolation function f(t) at the time t), and f(t1)=0. It is contemplated that three such primitive matrices, each for transforming samples of a different one of the three channels, would be cascaded to transform samples of all three of the channels. Such circuitry could be used when a seed or partially updated primitive matrix is applied on the audio data and the delta matrix is applied on the audio data and the two combined together using the interpolation factor.

The FIG. 3 circuitry is configured to apply the seed primitive matrix to four audio program channels S1, S2, S3, and S4 (i.e., to multiply samples of the channels by the matrix). More specifically, a sample of channel S1 is multiplied by coefficient $\alpha_0$ (identified as "m_coeff[p,0]") of the matrix, a sample of channel S2 is multiplied by coefficient $\alpha_1$ (identified as "m_coeff[p,1]") of the matrix, a sample of channel S3 is multiplied by coefficient $\alpha_2$ (identified as "m_coeff[p,2]") of the matrix, and a sample of channel S4 is multiplied by coefficient $\alpha_3$ (identified as "m_coeff[p,3]") of the matrix. The products are summed in summation element 10, and each sum output from element 10 is then quantized in quantization stage Qss to generate the quantized value which is the transformed version (included in channel S2') of the sample of channel S2. In a typical implementation, each sample of each of channels S1, S2, S3, and S4 comprises 24 bits (as indicated in FIG. 3), and the output of each multiplication element comprises 38 bits (as also indicated in FIG. 3), and quantization stage Qss outputs a 24 bit quantized value in response to each 38-bit value which is input thereto.

The FIG. 4 circuitry is configured to apply the interpolated primitive matrix to three audio program channels C1, C2, and C3 (i.e., to multiply samples of the channels by the matrix). More specifically, a sample of channel C1 is multiplied by coefficient $\alpha_0$ (identified as "m_coeff[p,0]") of the seed primitive matrix, a sample of channel C2 is multiplied by coefficient $\alpha_1$ (identified as "m_coeff[p,1]") of the seed primitive matrix, and a sample of channel S3 is multiplied by coefficient $\alpha_2$ (identified as "m_coeff[p,2]") of the seed primitive matrix. The products are summed in summation element 12, and each sum output from element 12 is then added (in stage 14) to the corresponding value output from interpolation factor stage 13. The value output from stage 14 is quantized in quantization stage Qss to generate the quantized value which is the transformed version (included in channel C3') of the sample of channel C3.

The same sample of channel C1 is multiplied by coefficient $\delta_0$ (identified as "delta_cf[p,0]") of the seed delta matrix, the sample of channel C2 is multiplied by coefficient $\delta_1$ (identified as "delta_cf[p,1]") of the seed delta matrix, and the sample of channel S3 is multiplied by coefficient $\delta_2$ (identified as "delta_cf[p,2]") of the seed delta matrix. The products are summed in summation element 11, and each sum output from element 11 is then quantized in quantization stage Qfine to generate a quantized value which is then multiplied (in interpolation factor stage stage 13) by the current value of the interpolation function, f(t).

In a typical implementation of FIG. 4, each sample of each of channels C1, C2, and C3 comprises 32 bits (as indicated in FIG. 4), and the output of each of summation elements 11, 12, and 14 comprises 50 bits (as also indicated in FIG. 4), and each of quantization stages Qfine and Qss outputs a 32 bit quantized value in response to each 50-bit value which is input thereto.

For example, a variation on the FIG. 4. circuit could transform a vector of samples of x audio channels, where x=2, 4, 8, or N channels. A cascade of x such variations on the FIG. 4 circuit could perform matrix multiplication of such x channels by an x×x seed matrix (or an interpolated version of such a seed matrix). For example, such a cascade of x such variations on the FIG. 4 circuit could implement stages 60 and 47 of decoder 42 (where x=8), or stages 61 and 48 of decoder 42 (where x=2), or stages 113 and 109 of decoder 102 (where x=N), or stages 112 and 108 of decoder 102 (where x=8), or stages 111 and 107 of decoder 102 (where x=6), or stages 110 and 106 of decoder 102 (where x=2).

In the FIG. 4 embodiment, the seed primitive matrix and the seed delta matrix are applied in parallel to each set (vector) of input samples (each such vector including one sample from each of the input channels).

With reference to FIG. 6, we next describe an embodiment of the invention in which the audio program to be decoded is an N-channel object-based audio program. The FIG. 6 system includes encoder 100 (an embodiment of the inventive encoder), delivery subsystem 31, and decoder 102 (an embodiment of the inventive decoder), coupled together as shown. Although subsystem 102 is referred to herein as a "decoder" it should be understood that may be implemented as a playback system including a decoding subsystem (configured to parse and decode a bitstream indicative of an encoded multichannel audio program) and other subsystems configured to implement rendering and at least some steps of playback of the decoding subsystem's output. Some embodiments of the invention are decoders which are not configured to perform rendering and/or playback (and which would typically be used with a separate rendering and/or playback system). Some embodiments of the invention are playback systems (e.g., a playback system including a decoding subsystem and other subsystems configured to implement rendering and at least some steps of playback of the decoding subsystem's output.

In the FIG. 6 system, encoder 100 is configured to encode the N-channel object-based audio program as an encoded bitstream including four substreams, and decoder 102 is configured to decode the encoded bitstream to render either the original N-channel program (losslessly), or an 8-channel downmix of the original N-channel program, or a 6-channel downmix of the original N-channel program, or a 2-channel downmix of the original N-channel program. Encoder 100 is coupled and configured to generate the encoded bitstream and to assert the encoded bitstream to delivery system 31.

Delivery system 31 is coupled and configured to deliver (e.g., by storing and/or transmitting) the encoded bitstream to decoder 102. In some embodiments, system 31 implements delivery of (e.g., transmits) an encoded multichannel audio program over a broadcast system or a network (e.g., the internet) to decoder 102. In some embodiments, system 31 stores an encoded multichannel audio program in a storage medium (e.g., a disk or set of disks), and decoder 102 is configured to read the program from the storage medium.

The block labeled "InvChAssign3" in encoder 100 is configured to perform channel permutation (equivalent to multiplication by a permutation matrix) on the channels of the input program. The permutated channels then undergo encoding in stage 101, which outputs N encoded signal channels. The encoded signal channels may (but need not) correspond to playback speaker channels. The encoded signal channels are sometimes referred to as "internal" channels since a decoder (and/or rendering system) typically decodes and renders the content of the encoded signal channels to recover the input audio, so that the encoded signal channels are "internal" to the encoding/decoding system. The encoding performed in stage 101 is equivalent to multiplication of each set of samples of the permutated channels by an encoding matrix (implemented as a cascade of matrix multiplications, identified as $P_n^{-1}, \ldots, P_1^{-1}, P_0^{-1}$.

Each matrix $P_n^{-1}, \ldots, P_1^{-1}$, and $P_0^{-1}$ (and thus the cascade applied by stage 101) is determined in subsystem 103, and is updated from time to time (typically infrequently) in accordance with a specified time-varying mix of the program's N channels to N encoded signal channels has been specified over the time interval.

In variations on the exemplary embodiment of FIG. 6, the input audio program comprises an arbitrary number (N or X, where X is greater than N) channels. In such variations, the N multichannel audio program channels that are indicated by the encoded bitstream output from the encoder, which may be losslessly recovered by the decoder, may be N channels of audio content which have been generated from the X-channel input audio program by performing matrix operations on the X-channel input audio program to apply a time-varying mix to the X channels of the input audio program, thereby determining the encoded audio content of the encoded bitstream.

Matrix determination subsystem 103 of FIG. 6 is configured to generate data indicative of the coefficients of four sets of output matrices (one set corresponding to each of four substreams of the encoded channels). Each set of output matrices is updated from time to time, so that the coefficients are also updated from time to time.

One set of output matrices consists of two rendering matrices, $P_0^2(t)$, $P_1^2(t)$, each of which is a primitive matrix (preferably a unit primitive matrix) of dimension 2×2, and is for rendering a first substream (a downmix substream) comprising two of the encoded audio channels of the encoded bitstream (to render a two-channel downmix of the input audio). Another set of output matrices may consist of as many as six rendering matrices, $P_0^6(t)$, $P_1^6(t)$, $P_2^6(t)$, $P_3^6(t)$, $P_4^6(t)$, and $P_5^6(t)$, each of which is a primitive matrix (preferably a unit primitive matrix) of dimension 6×6, and is for rendering a second substream (a downmix substream) comprising six of the encoded audio channels of the encoded bitstream (to render a six-channel downmix of the input audio). Another set of output matrices consists of as many as eight rendering matrices, $P_0^8(t)$, $P_1^8(t)$, . . . , $P_7^8(t)$, each of which is a primitive matrix (preferably a unit primitive matrix) of dimension 8×8, and is for rendering a third substream (a downmix substream) comprising eight of the encoded audio channels of the encoded bitstream (to render an eight-channel downmix of the input audio).

The other set of output matrices consists of N rendering matrices, $P_0(t), P_1(t), \ldots, P_n(t)$, each of which is a primitive matrix (preferably a unit primitive matrix) of dimension N×N, and is for rendering a fourth substream comprising all of the encoded audio channels of the encoded bitstream (for lossless recovery of the N-channel input audio program). For each time, t, a cascade of the rendering matrices, $P_0^2(t)$, $P_1^2(t)$, can be interpreted as a rendering matrix for the channels of the first substream, a cascade of the rendering matrices, $P_0^6(t)$, $P_1^6(t)$, . . . , $P_5^6(t)$, can also be interpreted as a rendering matrix for the channels of the second substream, a cascade of the rendering matrices, $P_0^8(t)$, $P_1^8(t)$, . . . , $P_7^8(t)$, can also be interpreted as a rendering matrix for the channels of the third substream, and a cascade of the rendering matrices, $P_0(t), P_1(t), \ldots, P_n(t)$, is equivalent to a rendering matrix for the channels of the fourth substream.

The coefficients (of each rendering matrix) that are output from subsystem 103 to packing subsystem 104 are metadata indicating relative or absolute gain of each channel to be included in a corresponding mix of channels of the program. The coefficients of each rendering matrix (for an instant of time during the program) represent how much each of the channels of a mix should contribute to the mix of audio content (at the corresponding instant of the rendered mix) indicated by the speaker feed for a particular playback system speaker.

The N encoded audio channels (output from encoding stage 101), the output matrix coefficients (generated by subsystem 103), and typically also additional data (e.g., for inclusion as metadata in the encoded bitstream) are asserted to packing subsystem 104, which assembles them into the encoded bitstream which is then asserted to delivery system 31.

The encoded bitstream includes data indicative of the N encoded audio channels, the four sets of time-varying output matrices (one set corresponding to each of four substreams of the encoded channels), and typically also additional data (e.g., metadata regarding the audio content).

Stage 103 of encoder 100 updates each set of output matrices (e.g., set $P_0^2$, $P_1^2$, or set $P_0, P_1, \ldots, P_n$) from time to time. The first set of matrices $P_0^2$, $P_1^2$ that is output (at a first time, t1) is a seed matrix (implemented as a cascade of primitive matrices, e.g., unit primitive matrices) which determines a linear transformation to be performed at the first time during the program (i.e., on samples of two channels of the encoded output of stage 101, corresponding to the first time). The first set of matrices $P_0^6(t)$, $P_1^6(t), \ldots, P_n^6(t)$, that is output (at time t1) is a seed matrix (implemented as a cascade of primitive matrices, e.g., unit primitive matrices) which determines a linear transformation to be performed at the first time during the program (i.e., on samples of six channels of the encoded output of stage 101, corresponding to the first time). The first set of matrices $P_0^8(t), P_1^8(t), \ldots, P_n^8(t)$, that is output (at time t1) is a seed matrix (implemented as a cascade of primitive matrices, e.g., unit primitive matrices) which determines a linear transformation to be performed at the first time during the program (i.e., on samples of eight channels of the encoded output of stage 101, corresponding to the first time). The first set of matrices $P_0, P_1, \ldots, P_n$ that is output (at time t1) is a seed matrix (implemented as a cascade of unit primitive matrices) which determines a linear transformation to be performed at the first time during the program (i.e., on samples of all channels of the encoded output of stage 101 corresponding to the first time).

Each updated set of matrices $P_0^2$, $P_1^2$ that is output from stage 103 is an updated seed matrix (implemented as a cascade of primitive matrices, which may also be referred to as a cascade of seed primitive matrices) which determines a linear transformation to be performed at the update time during the program (i.e., on samples of two channels of the encoded output of stage 101, corresponding to the update time). Each updated set of matrices $P_0^6(t), P_1^6(t), \ldots, P_n^6(t)$, that is output from stage 103 is an updated seed matrix (implemented as a cascade of primitive matrices, which may also be referred to as a cascade of seed primitive matrices) which determines a linear transformation to be performed at the update time during the program (i.e., on samples of six channels of the encoded output of stage 101, corresponding to the update time). Each updated set of matrices $P_0^8(t)$, $P_1^8(t)$, . . . , $P_n^8(t)$, that is output from stage 103 is an updated seed matrix (implemented as a cascade of primitive matrices, which may also be referred to as a cascade of seed primitive matrices) which determines a linear transformation to be performed at the update time during the program (i.e., on samples of two channels of the encoded output of stage 101, corresponding to the update time). Each updated set of matrices $P_0$, $P_1$, . . . , $P_n$ that is output from stage 103 is also seed matrix (implemented as a cascade of unit primitive matrices, which may also be referred to as a cascade of unit seed primitive matrices) which determines a linear transformation to be performed at the update time during the program (i.e., on samples of all channels of the encoded output of stage 101 corresponding to the first time).

Output stage 103 is also configured to output interpolation values, which (with an interpolation function for each seed matrix) enable decoder 102 to generated interpolated versions of the seed matrices (corresponding to times after the first time, t1, and between the update times). The interpolation values (which may include data indicative of each interpolation function) are included by stage 104 in the encoded bitstream output from encoder 100. Examples of such interpolation values are described elsewhere herein (the interpolation values may include a delta matrix for each seed matrix).

With reference to decoder 102 of FIG. 6, parsing subsystem 105 is configured to accept (read or receive) the encoded bitstream from delivery system 31 and to parse the encoded bitstream. Subsystem 105 is operable to assert a first substream comprising only two encoded channels of the encoded bitstream), output matrices ($P_0$, $P_1$, . . . , $P_n$) corresponding to the fourth (top) substream, and output matrices ($P_0^2$, $P_1^2$) corresponding to the first substream, to matrix multiplication stage 106 (for processing which results in a 2-channel downmix presentation of content of the original N-channel input program). Subsystem 105 is operable to assert the second substream of the encoded bitstream comprising six encoded channels of the encoded bitstream), and output matrices ($P_0^6(t)$, $P_1^6(t)$, . . . , $P_n^6(t)$) corresponding to the second substream, to matrix multiplication stage 107 (for processing which results in a 6-channel downmix presentation of content of the original N-channel input program). Subsystem 105 is operable to assert a third substream of the encoded bitstream comprising eight encoded channels of the encoded bitstream), and output matrices ($P_0^8(t)$, $P_1^8(t)$, . . . , $P_n^8(t)$) corresponding to the third substream, to matrix multiplication stage 108 (for processing which results in an eight-channel downmix presentation of content of the original N-channel input program). Subsystem 105 is also operable to assert the fourth (top) substream of the encoded bitstream (comprising all encoded channels of the encoded bitstream), and corresponding output matrices ($P_0$, $P_1$, . . . , $P_n$) to matrix multiplication stage 109 for processing which results in lossless reproduction of the original N-channel program.

Interpolation stage 113 is coupled to receive each seed matrix for the fourth substream (i.e., the initial set of primitive matrices, $P_0$, $P_1$, . . . , $P_n$, for time t1, and each updated set of primitive matrices, $P_0$, $P_1$, . . . , $P_n$) included in the encoded bitstream, and the interpolation values (also included in the encoded bitstream) for generating interpolated versions of each seed matrix. Stage 113 is coupled and configured to pass through (to stage 109) each such seed matrix, and to generate (and assert to stage 109) interpolated versions of each such seed matrix (each interpolated version corresponding to a time after the first time, t1, and before the first seed matrix update time, or between subsequent seed matrix update times).

Interpolation stage 112 is coupled to receive each seed matrix for the third substream (i.e., the initial set of primitive matrices, $P_0^8$, $P_1^8$, . . . , $P_n^8$, for time t1, and each updated set of primitive matrices, $P_0^8$, $P_1^8$, . . . , $P_n^8$) included in the encoded bitstream, and the interpolation values (also included in the encoded bitstream) for generating interpolated versions of each such seed matrix. Stage 112 is coupled and configured to pass through (to stage 108) each such seed matrix, and to generate (and assert to stage 108) interpolated versions of each such seed matrix (each interpolated version corresponding to a time after the first time, t1, and before the first seed matrix update time, or between subsequent seed matrix update times).

Interpolation stage 111 is coupled to receive each seed matrix for the second substream (i.e., the initial set of primitive matrices, $P_0^6$, $P_1^6$, . . . , $P_n^6$, for time t1, and each updated set of primitive matrices, $P_0^6$, $P_1^6$, . . . , $P_n^6$) included in the encoded bitstream, and the interpolation values (also included in the encoded bitstream) for generating interpolated versions of each such seed matrix. Stage 111 is coupled and configured to pass through (to stage 107) each such seed matrix, and to generate (and assert to stage 107) interpolated versions of each such seed matrix (each interpolated version corresponding to a time after the first time, t1, and before the first seed matrix update time, or between subsequent seed matrix update times).

Interpolation stage 110 is coupled to receive each seed matrix for the first substream (i.e., the initial set of primitive matrices, $P_0^2$ and $P_1^2$, for time t1, and each updated set of primitive matrices, $P_0^2$ and $P_1^2$) included in the encoded bitstream, and the interpolation values (also included in the encoded bitstream) for generating interpolated versions of each such seed matrix. Stage 110 is coupled and configured to pass through (to stage 106) each such seed matrix, and to generate (and assert to stage 106) interpolated versions of each such seed matrix (each interpolated version corresponding to a time after the first time, t1, and before the first seed matrix update time, or between subsequent seed matrix update times).

Stage 106 multiplies each vector of two audio samples of the two encoded channels of the first substream by the most recently updated cascade of the matrices $P_0^2$ and $P_1^2$ (e.g., a cascade of the most recent interpolated versions of matrices $P_0^2$ and $P_1^2$ generated by stage 110), and each resulting set of two linearly transformed samples undergoes channel permutation (equivalent to multiplication by a permutation matrix) represented by the block titled "ChAssign0" to yield each pair of samples of the required 2 channel downmix of the N original audio channels. The cascade of matrixing operations performed in encoder 40 and decoder 102 is equivalent to application of a downmix matrix specification that transforms the N input audio channels to the 2-channel downmix.

Stage 107 multiplies each vector of six audio samples of the six encoded channels of the second substream by the most recently updated cascade of the matrices $P_0^6$, . . . , $P_n^6$ (e.g., a cascade of the most recent interpolated versions of matrices $P_0^6$, . . . , $P_n^6$ generated by stage 111), and each resulting set of six linearly transformed samples undergoes channel permutation (equivalent to multiplication by a permutation matrix) represented by the block titled "ChAssign1" to yield each set of samples of the required 6 channel downmix of the N original audio channels. The cascade of matrixing operations performed in encoder 100 and decoder 102 is equivalent to application of a downmix matrix specification that transforms the N input audio channels to the 6-channel downmix.

Stage 108 multiplies each vector of eight audio samples of the eight encoded channels (of the third substream by the most recently updated cascade of the matrices $P_0^8, \ldots, P_n^8$ (e.g., a cascade of the most recent interpolated versions of matrices $P_0^8, \ldots, P_n^8$ generated by stage 112), and each resulting set of eight linearly transformed samples undergoes channel permutation (equivalent to multiplication by a permutation matrix) represented by the block titled "ChAssign2" to yield each pair of samples of the required eight channel downmix of the N original audio channels. The cascade of matrixing operations performed in encoder 100 and decoder 102 is equivalent to application of a downmix matrix specification that transforms the N input audio channels to the 8-channel downmix.

Stage 109 multiplies each vector of N audio samples (one from each of the full set of N encoded channels of the encoded bitstream) by the most recently updated cascade of the matrices $P_0, P_1, \ldots, P_n$ (e.g., a cascade of the most recent interpolated versions of matrices $P_0, P_1, \ldots, P_n$ generated by stage 113) and each resulting set of N linearly transformed samples undergoes channel permutation (equivalent to multiplication by a permutation matrix) represented by the block titled "ChAssign3" to yield each set of N samples of the losslessly recovered original N-channel program. In order that the output N channel audio is exactly the same as the input N channel audio (to achieve the "lossless" characteristic of the system), the matrixing operations performed in encoder 100 should be exactly (including quantization effects) the inverse of the matrixing operations performed in decoder 102 on the fourth substream of the encoded bitstream (i.e., each multiplication in stage 109 of decoder 102 by a cascade of matrices $P_0, P_1, \ldots, P_n$). Thus, in FIG. 6, the matrixing operations in stage 103 of encoder 100 are identified as a cascade of the inverse matrices of the matrices $P_0, P_1, \ldots, P_n$, in the opposite sequence applied in stage 109 of decoder 102, namely: $P_n^{-1}, \ldots, P_1^{-1}, P_0^{-1}$.

In some implementations, parsing subsystem 105 is configured to extract a check word from the encoded bitstream, and stage 109 is configured to verify whether the N channels (of at least one segment of a multichannel audio program) recovered by stage 109 have been correctly recovered, by comparing a second check word derived (e.g., by stage 109) from audio samples generated by stage 109 against the check word extracted from the encoded bitstream.

Stage "ChAssign3" of decoder 102 applies to the output of stage 109 the inverse of the channel permutation applied by encoder 100 (i.e., the permutation matrix represented by stage "ChAssign3" of decoder 102 is the inverse of that represented by element "InvChAssign3" of encoder 100).

In variations on subsystems 100 and 102 of the system shown in FIG. 6, one or more of the elements are omitted or additional audio data processing units are included.

The rendering matrix coefficients $P_0^8, \ldots, P_n^8$ (or $P_0^6, \ldots, P_n^6$, or $P_0^2$ and $P_1^2$) asserted to stage 108 (or 107 or 106) of decoder 100 are metadata (e.g., spatial position metadata) of the encoded bitstream which are indicative of (or may be processed with other data to be indicative of) relative or absolute gain of each speaker channel to be included in a downmix of the channels of the original N-channel content encoded by encoder 100.

In contrast, the configuration of the playback speaker system to be employed to render a full set of channels of an object-based audio program (which is losslessly recovered by decoder 102) is typically unknown at the time the encoded bitstream is generated by encoder 100. The N channels losslessly recovered by decoder 102 may need to be processed (e.g., in a rendering system included in decoder 102 (but not shown in FIG. 6) or coupled to decoder 102) with other data (e.g., data indicative of configuration of a particular playback speaker system) to determine how much each channel of the program should contribute to a mix of audio content (at each instant of the rendered mix) indicated by the speaker feed for a particular playback system speaker. Such a rendering system may process spatial trajectory metadata in (or associated with) each losslessly recovered object channel, to determine the speaker feeds for the speakers of the particular playback speaker system to be employed for playback of the losslessly recovered content.

In some embodiments of the inventive encoder, the encoder is provided with (or generates) a dynamically varying specification A(t) that specifies how to transform all channels of an N-channel audio program (e.g., an object-based audio program) into a set of N encoded channels, and at least one dynamically varying downmix specification that specifies each downmix of content of the N encoded channels to an M1-channel presentation (where M1 is less than N, e.g., M1=2, or M1=8, when N is greater than 8). In some embodiments, the encoder's job is to pack the encoded audio and data indicative of each such dynamically varying specification into an encoded bitstream having predetermined format (e.g., a TrueHD bitstream). For example, this may be done such that a legacy decoder (e.g., a legacy TrueHD decoder) is able to recover at least one downmix presentation (having M1 channels), while an enhanced decoder may be used to recover (losslessly) the original N-channel audio program. Given the dynamically varying specifications, the encoder may assume that the decoder will determine interpolated primitive matrices $P_0, P_1, \ldots, P_n$ from interpolation values (e.g., seed primitive matrix and seed delta matrix information) included in the encoded bitstream to be delivered to the decoder. The decoder then performs interpolation to determine the interpolated primitive matrices which invert the encoder's operations that produced the encoded audio content of the encoded bitstream (e.g., to recover losslessly the content that was encoded, by undergoing matrix operations, in the encoder). Optionally the encoder may choose the primitive matrices for the lower substreams (i.e., the substreams indicative of downmixes of content of a top, N-channel substream) to be non-interpolated primitive matrices (and include a sequence of sets of such non-interpolated primitive matrices in the encoded bitstream), while also assuming that the decoder will determine interpolated primitive matrices ($P_0, P_1, \ldots, P_n$) for lossless recovery of the content of the top (N-channel) substream from interpolation values (e.g., seed primitive matrix and seed delta matrix information) included in the encoded bitstream to be delivered to the decoder.

For example, an encoder (e.g., stage 44 of encoder 40, or stage 103 of encoder 100) may be configured to choose seed primitive and seed delta matrices (for use with an interpolation function, f(t)), by sampling the specification A(t) at different time instants t1, t2, t3, . . . (which maybe closely spaced), deriving the corresponding seed primitive matrices (e.g., as in a conventional TrueHD encoder) and to then calculate the rate of change of individual elements in the seed primitive matrices to calculate the interpolation values (e.g., "delta" information indicative of a sequence of seed delta matrices). The first set of seed primitive matrices would be the primitive matrices derived from the specification for the first of such time instants, A(t1). It is possible that a subset of the primitive matrices may not change at all over time, in which case the decoder would responds to appropriate control information in the encoded bitstream by zeroing out any corresponding delta information (i.e., to set the rate of change of such subset of primitive matrices to zero).

Variations on the FIG. 6 embodiment of the inventive encoder and decoder may omit interpolation for some (i.e., at least one) of the substreams of the encoded bitstream. For example, interpolation stages 110, 111, and 112 may be omitted, and the corresponding matrices $P_0^2$, $P_1^2$, and $P_0^6$, $P_1^6$, . . . $P_n^6$, and $P_0^8$, $P_1^8$, . . . $P_n^8$, may be updated (in the encoded bitstream) with sufficient frequency so that interpolation between instants at which they are updated is unnecessary. For another example, if matrices $P_0^6$, $P_1^6$, . . . $P_n^6$, are updated with sufficient frequency so that interpolation at times between the updates is unnecessary, interpolation stage 111 is unnecessary and may be omitted. Thus, a conventional decoder (not configured in accordance with the invention to perform interpolation) could render the 6-channel downmix presentation in response to the encoded bitstream.

As noted above, dynamic rendering matrix specifications (e.g., A(t)) may stem not only from the need to render object-based audio programs, but also due to the need to implement clip protection. Interpolated primitive matrices may enable a faster ramp to and release from clip-protection of a downmix, as well as lowering the data rate required to convey the matrixing coefficients.

We next describe an example of operation of an implementation of the FIG. 6 system. In this case, the N-channel input program is a three-channel object-based audio program including a bed channel, C, and two object channels, U and V. It is desired that the program be encoded for transport via a TrueHD stream having two substreams such that a 2 channel downmix (a rendering of the program to a two channel speaker set up) can be retrieved using the first substream and the original 3-channel input program can be recovered losslessly by using both substreams.

Let the rendering equation (or downmix equation) from the input program to the 2 channel mix be given by:

$$A_2(t) = \begin{bmatrix} 0.707 & \sin(vt) & \cos(vt) \\ 0.707 & \cos(vt) & \sin(vt) \end{bmatrix}$$

where the first column corresponds to the gains of the bed channel (a center channel, C) that feeds equally into the L and R channels. The second and third columns, respectively, correspond to object channel U and the object channel V. The first row corresponds to the L channel of the 2ch downmix and the second row corresponds to the R channel. The two objects are moving towards each other at a speed determined by.

We will examine the rendering matrices at three different time instants t1, t2 and t3.

In this example we will assume t1=0, i.e., $$A_2(t1) = \begin{bmatrix} 0.707 & 0 & 1 \\ 0.707 & 1 & 0 \end{bmatrix}.$$

In other words at t1, object U completely feeds into R and object V completely mixes down into L. As the objects move towards each other their contribution to the farther speaker increases. To develop the example further, let us say that $$v = \frac{\text{pi}}{4} \times \frac{1}{40T},$$

where T is the length of an access unit (typically 0.8333 ms or 40 samples at 48 kHz sampling rate). Thus at t=40 T the two objects are at the center of the scene. We will now consider t2=1T and t3=30 T, so that:

$$A_2(t2) = \begin{bmatrix} 0.707 & 0.2903 & 0.9569 \\ 0.707 & 0.9569 & 0.2902 \end{bmatrix}$$

$$A_2(t3) = \begin{bmatrix} 0.707 & 0.5556 & 0.8315 \\ 0.707 & 0.8315 & 0.5556 \end{bmatrix}$$

Let us consider decomposing the provided specification $A_2(t)$ into input and output primitive matrices. For the sake of simplicity let us assume that matrices $P_0^2$, $P_1^2$ are identity matrices and chAssign0 (in the decoder 102) is the identity channel assignment, i.e., equal to the trivial permutation (identity matrix).

We can see that:

$$\begin{bmatrix} 0.707 & 0 & 1 \\ 0.707 & 1 & 0 \\ 1 & -1.414 & 4.243 \end{bmatrix} = \underbrace{\begin{bmatrix} 1 & 0 & 0 \\ 2 & 1 & -0.707 \\ 0 & 0 & 1 \end{bmatrix}}_{P_0^{-1}(t1)} \underbrace{\begin{bmatrix} 1 & -2 & 0.7070 \\ 0 & 1 & 0 \\ 0 & 0 & 1 \end{bmatrix}}_{P_1^{-1}(t1)} \underbrace{\begin{bmatrix} 1 & 0 & 0 \\ 0 & 1 & 0 \\ -1.414 & 4.243 & 1 \end{bmatrix}}_{P_2^{-1}(t1)} \underbrace{\begin{bmatrix} 0 & 1 & 0 \\ 0 & 0 & 1 \\ 1 & 0 & 0 \end{bmatrix}}_{InvChAssign1(t1)}$$

The first two rows of the above product are exactly the specification $A_2(t1)$. In other words the primitive matrices $P_0^{-1}(t1)$, $P_1^{-1}(t1)$, $P_2^{-1}(t1)$, and channel assignment indicated by InvChAssign1(t1) together result in transforming the input channel C, Object U, and Object V into three internal channels the first two of which are exactly the required downmixes L and R. Thus the above decomposition of A(t) into the primitive matrices $P_0^{-1}(t1)$, $P_1^{-1}(t1)$, $P_2^{-1}(t1)$, and channel assignment InvChAssign1(t1) is a valid choice of input primitive matrices if the output primitive matrices and channel assignment for the two channel presentation have been chosen to be identity matrices. Note that the input primitive matrices are lossless invertible to retrieve C, Object U and Object V by a decoder that operates on all three internal channels. A two channel decoder, however, would only need internal channels 1 and 2 and apply the output primitive matrices $P_0^2$, $P_1^2$ and chAssign0, which in this case are all identity.

Similarly we can identify:

$$\begin{bmatrix} 0.707 & 0.2903 & 0.9569 \\ 0.707 & 0.9569 & 0.2903 \\ 1 & -1.004 & 4.890 \end{bmatrix} = \underbrace{\begin{bmatrix} 1 & 0 & 0 \\ 1.666 & 1 & -0.4713 \\ 0 & 0 & 1 \end{bmatrix}}_{P_0^{-1}(t2)} \underbrace{\begin{bmatrix} 1 & -2.5 & 0.707 \\ 0 & 1 & 0 \\ 0 & 0 & 1 \end{bmatrix}}_{P_1^{-1}(t2)} \underbrace{\begin{bmatrix} 1 & 0 & 0 \\ 0 & 1 & 0 \\ -1.003 & 4.889 & 1 \end{bmatrix}}_{P_2^{-1}(t2)} \underbrace{\begin{bmatrix} 0 & 1 & 0 \\ 0 & 0 & 1 \\ 1 & 0 & 0 \end{bmatrix}}_{InvChAssign1(t2)}$$

where the first two rows are identical to A(t2), and $$\begin{bmatrix} 0.707 & 0.5556 & 0.8315 \\ 0.707 & 0.8315 & 0.5556 \\ 1 & -0.628 & 7.717 \end{bmatrix} = \underbrace{\begin{bmatrix} 1 & 0 & 0 \\ 1.2759 & 1 & -0.1950 \\ 0 & 0 & 1 \end{bmatrix}}_{P_0^{-1}(t3)}$$

$$\underbrace{\begin{bmatrix} 1 & -4.624 & 0.707 \\ 0 & 1 & 0 \\ 0 & 0 & 1 \end{bmatrix}}_{P_1^{-1}(t3)} \underbrace{\begin{bmatrix} 1 & 0 & 0 \\ 0 & 1 & 0 \\ -0.628 & 7.717 & 1 \end{bmatrix}}_{P_2^{-1}(t3)} \underbrace{\begin{bmatrix} 0 & 1 & 0 \\ 0 & 0 & 1 \\ 1 & 0 & 0 \end{bmatrix}}_{InvChAssign1(t3)}$$

where the first two rows are identical to A(t3).

A legacy TrueHD encoder(which does not implement the present invention) may choose to transmit the (inverse of the) primitive matrices designed above at t1, t2, and t3, i.e., $\{P_0(t1),P_1(t1),P_2(t1)\},\{P_0(t2),P_1(t2),P_2(t2)\},\{P_0(t3),P_1(t3),P_2(t3)\}$. In this case the specification at any time t in between t1 and t2 is approximated by the specification at A(t1), and between t2 and t3 is approximated by A(t2).

In the exemplary embodiment of the FIG. 6 system, the primitive matrix $P_0^{-1}(t)$ at t=t1, or t=t2, or t=t3 operates on the same channel (channel 2), i.e., the non-trivial row in all three cases is the second row. Similar is the case with $P_1^{-1}(t)$ and $P_2^{-1}(t)$. Further InvChAssign1 at each of the time instants is the same.

Thus, to implement encoding by the exemplary embodiment of encoder 100 of FIG. 6), we can calculate the following delta matrices:

$$\Delta_0(t1) = \frac{P_0(t2) - P_0(t1)}{15} = \begin{bmatrix} 0 & 0 & 0 \\ 0.0222 & 0 & -0.0157 \\ 0 & 0 & 0 \end{bmatrix}$$

$$\Delta_1(t1) = \frac{P_1(t2) - P_1(t1)}{15} = \begin{bmatrix} 0 & 0.0333 & 0 \\ 0 & 0 & 0 \\ 0 & 0 & 0 \end{bmatrix}$$

$$\Delta_2(t1) = \frac{P_2(t2) - P_2(t1)}{15} = \begin{bmatrix} 0 & 0 & 0 \\ 0 & 0 & 0 \\ -0.0274 & -0.0431 & 0 \end{bmatrix}$$

and $$\Delta_0(t2) = \frac{P_0(t3) - P_0(t2)}{15} = \begin{bmatrix} 0 & 0 & 0 \\ 0.0261 & 0 & -0.0184 \\ 0 & 0 & 0 \end{bmatrix}$$

$$\Delta_1(t2) = \frac{P_1(t3) - P_1(t2)}{15} = \begin{bmatrix} 0 & 0.1416 & 0 \\ 0 & 0 & 0 \\ 0 & 0 & 0 \end{bmatrix}$$

$$\Delta_2(t2) = \frac{P_2(t3) - P_2(t2)}{15} = \begin{bmatrix} 0 & 0 & 0 \\ 0 & 0 & 0 \\ -0.0250 & -0.01885 & 0 \end{bmatrix}$$

In contrast to the legacy TrueHD encoder, an interpolated-matrixing enabled TrueHD encoder (the exemplary embodiment of encoder 100 of FIG. 6) may choose to send the seed (primitive and delta) matrices $\{P_0(t1),P_1(t1),P_2(t1)\},\{\Delta_0(t1),\Delta_1(t1),\Delta_2(t1)\},\{\Delta_0(t2),\Delta_1(t2),\Delta_2(t2)\}$.

The primitive matrices and delta matrices at any intermediate time-instant is derived by interpolation. The achieved downmix equations at a given time t in between t1 and t2 can be derived as the first two rows of the product:

$$\left(P_0^{-1}(t1) - \Delta_0(t1) * \frac{t}{T}\right)\left(P_1^{-1}(t1) - \Delta_1(t1) * \frac{t}{T}\right)\left(P_2^{-1}(t1) - \Delta_2(t1) * \frac{t}{T}\right)\begin{bmatrix} 0 & 1 & 0 \\ 0 & 0 & 1 \\ 1 & 0 & 0 \end{bmatrix} \text{ and}$$

between t2 and t3, as $$\left(P_0^{-1}(t2) - \Delta_0(t2) * \frac{t}{T}\right)\left(P_1^{-1}(t2) - \Delta_1(t2) * \frac{t}{T}\right)\left(P_2^{-1}(t2) - \Delta_2(t2) * \frac{t}{T}\right)\begin{bmatrix} 0 & 1 & 0 \\ 0 & 0 & 1 \\ 1 & 0 & 0 \end{bmatrix}.$$

In the above the matrices $\{P_0(t2),P_1(t2),P_2(t2)\}$ are not actually transmitted but are derived as the primitive matrices of the last point of interpolation with the delta matrices $\{\Delta_0(t1),\Delta_1(t1),\Delta_2(t1)\}$.

Figure 7:
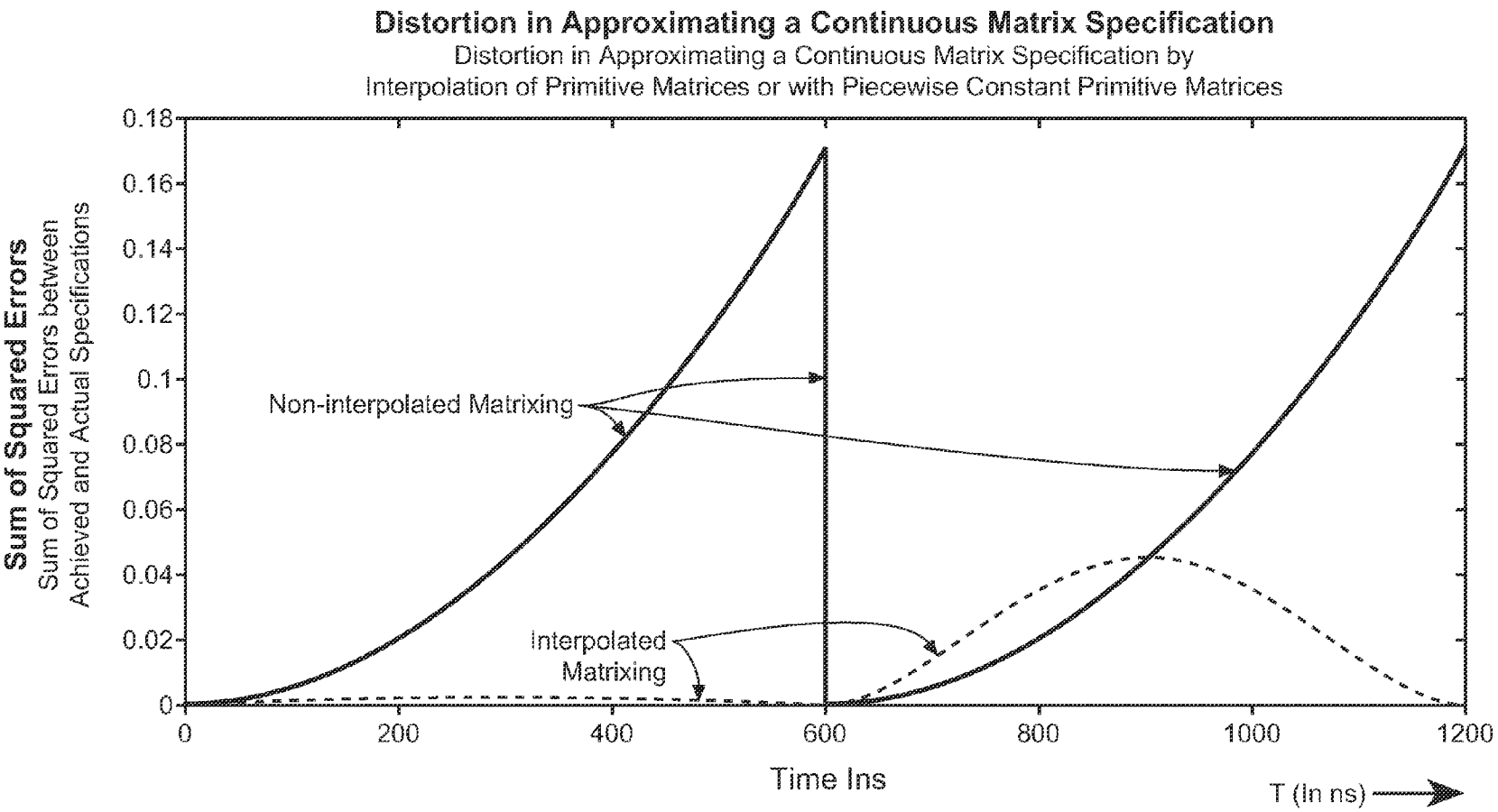
FIG. 7 is a graph of the sum of squared errors between an achieved specification and a true specification at different instants of time, t, using interpolated primitive matrices (the curve labeled "Interpolated Matrixing") and with piecewise constant (not interpolated) primitive matrices (the curve labeled "Non-interpolated Matrixing).

We thus know the achieved downmix equations at each instant "t" for both of the above scenarios. We can thus calculate the mismatch between the approximation at a given time "t" and the true specification for that time instant. FIG. 7 is a graph of the sum of squared errors between the achieved specification and the true specification at different instants of time t, using interpolation of primitive matrices (the curve labeled "Interpolated Matrixing") and with piece-wise constant (not interpolated) primitive matrices (the curve labeled "Non-interpolated Matrixing). It is apparent from FIG. 7 that interpolated matrixing results in achieving the specification $A_2(t)$ significantly more closely compared to non-interpolated matrixing in the region 0-600 s (t1–t2). To achieve the same level of distortion with non-interpolated matrixing one might have had to send matrix updates at multiple points in between t1 and t2.

Non-interpolated matrixing may result in an achieved downmix that is closer to the true specification at some intermediate time instants (e.g., between 600 s-900 s in the FIG. 7 example) but the error in non-interpolated matrixing continuously builds up with decreasing time to the next matrix update while the error with interpolated matrixing diminish near the update points (in this case at t3=30*T=1200 s). The error in interpolated matrixing could be further reduced by sending yet another delta update in between t2 and t3.

Various embodiments of the invention implement one or more of the following features:

1. transformation of one set of audio channels to an equal number of other audio channels by applying a sequence of primitive matrices (preferably, unit primitive matrices) where each of at least some of the primitive matrices is an interpolated primitive matrix calculated as a linear combination (determined in accordance with an interpolation function) of a seed primitive matrix and a seed delta matrix operating on the same audio channel. The linear combination coefficient is determined by the interpolation faction (i.e., each coefficient of an interpolated primitive matrix is a linear combination A+f(t)B, where A is a coefficient of the seed primitive matrix, B is a corresponding coefficient of the seed delta matrix, and f(t) is the value of the interpolation function at the time, t, associated with the interpolated primitive matrix). In some cases, the transformation is performed on encoded audio content of an encoded bitstream to implement lossless recovery of audio content which has been encoded to generate the encoded bitstream;

2. a transformation according to above feature 1, in which application of an interpolated primitive matrix is achieved by applying the seed primitive matrix and seed delta matrix separately on the audio channels to be transformed, and linearly combining the resultant audio samples (e.g., the matrix multiplications by the seed primitive matrix are performed in parallel with the matrix multiplications by the seed delta matrix, as in the FIG. 4 circuit);

3. a transformation according to above feature 1, in which the interpolation factor is held substantially constant over some intervals (e.g., short intervals) of samples of an encoded bitstream, and the most recent seed primitive matrix is updated (by interpolation) only during intervals in which the interpolation factor changes (e.g., in order to reduce the complexity of processing in a decoder);

4. a transformation according to above feature 1, in which the interpolated primitive matrices are unit primitive matrices. In this case, multiplication by a cascade of unit primitive matrices (in an encoder) followed by multiplication (in a decoder) by a cascade of their inverses can be implemented losslessly with finite precision processing;

5. a transformation according to above feature 1, wherein the transform is performed in an audio decoder which extracts encoded audio channels and seed matrices from an encoded bitstream, wherein the decoder is preferably configured to verify whether the decoded (post-matrixed) audio has been correctly determined, by comparing a check word derived from the post-matrixed audio against a check word extracted from the encoded bitstream;

6. a transformation according to above feature 1, wherein the transform is performed in a decoder of a lossless audio coding system which extracts encoded audio channels and seed matrices from an encoded bitstream, and the encoded audio channels have been generated by a corresponding encoder that applies the lossless inverse primitive matrices to input audio, thereby encoding the input audio losslessly into the bitstream;

7. a transformation according to above feature 1, wherein the transform is performed in a decoder which multiplies received encoded channels by a cascade of primitive matrices, and only a subset of the primitive matrices is determined by interpolation (i.e., updated versions of the other primitive matrices may be delivered to the decoder from time to time, but the decoder does not perform interpolation to update them);

8. a transformation according to above feature 1, wherein the seed primitive matrices, seed delta matrices, and interpolation function are chosen such that a subset of the encoded channels created by an encoder can be transformed via matrixing operations performed (using the matrices and interpolation function) by a decoder to achieve specific downmixes of the original audio encoded by the encoder;

9. a transformation according to above feature 8, where the original audio is an object-based audio program, and the specific downmixes correspond to rendering of channels of the program to static speaker layouts (e.g., stereo, or 5.1 channel, or 7.1 channel);

10. a transformation according to above feature 9, where audio objects indicated by the program are dynamic so that the downmix specifications to a particular static speaker layout change instantaneously, with the instantaneous change accommodated by performing interpolated matrixing on the encoded audio channels to create a downmix presentation;

11. a transformation according to above feature 1, wherein an interpolation enabled decoder (configured to perform interpolation in accordance with an embodiment of the invention) is also capable of decoding substreams of an encoded bitstream in conformance with a legacy syntax that without performing interpolation to determine any interpolated matrix;

12. a transformation according to above feature 1, where the primitive matrices are designed to exploit inter-channel correlation to achieve better compression; and 13. a transformation according to above feature 1, wherein interpolated matrixing is used to achieve dynamic downmix specifications designed for clip protection.

Given that downmix matrices generated using interpolation in accordance with an embodiment of the invention (for recovering downmix presentations from an encoded bitstream) typically continuously change when the source audio is an object-based audio program, seed primitive matrices employed (i.e., included in the encoded bitstream) in typical embodiments of the invention typically need to be updated often to recover such downmix presentations.

If seed primitive matrices are updated frequently, in order to closely approximate a continuously varying matrix specification, the encoded bitstream typically includes data indicative of a sequence of cascades of seed primitive matrix sets, $\{P_0(t1),P_1(t1), \ldots, P_n(t1)\}$, $\{P_0(t21),P_1(t2), \ldots, P_n(t2)\}$, $\{P_0(t3),P_1(t3), \ldots, P_n(t3)\}$, and so on. This allows a decoder to recover the specified cascade of matrices at each of the updating time instants t1, t2, t3, . . . . Since the rendering matrices specified in systems for rendering object-based audio programs typically vary continuously in time, each seed primitive matrix (in a sequence of cascades of seed primitive matrices included in the encoded bitstream) may have the same primitive matrix configuration (at least over an interval of the program). The coefficients in the primitive matrices may themselves change over time but the matrix configuration does not change (or does not change as frequently as do the coefficients). The matrix configuration for each cascade may be determined by such parameters as 1. the number of primitive matrices in the cascade,
2. the order of channels that they manipulate,
3. the order of magnitude of coefficients in them,
4. the resolution (in bits) required to represent the coefficients, and
5. and the positions of coefficients that are identically zero.

The parameters which indicate such a primitive matrix configuration may remain unchanged during an interval of many seed matrix updates. One or more of such parameters may need to be transmitted via the encoded bitstream to the decoder in order for the decoder to operate as desired. Since such configuration parameters may not change as frequently as the primitive matrix updates themselves, in some embodiments the encoded bitstream syntax independently specifies whether matrix configuration parameters are transmitted alongside an update to the matrix coefficients of a set of seed matrices. In contrast, in conventional TrueHD encoding matrix updates (indicated by an encoded bitstream) are necessarily accompanied by configuration updates. In contemplated embodiments of the invention, the decoder retains and uses the last received matrix configuration information if an update is received only for matrix coefficients (i.e., without a matrix configuration update).

While it is envisioned that interpolated matrixing will typically allow a low seed matrix update rate, the contemplated embodiments (in which a matrix configuration update may or may not accompany each seed matrix update) are expected to efficiently transmit configuration information and further reduce the bit rate required for updating rendering matrices. In the contemplated embodiments, the configuration parameters may include parameters relevant to each seed primitive matrix, and/or parameters relevant to transmitted delta matrices.

In order to minimize the overall transmitted bit rate, the encoder may implement a tradeoff between updating the matrix configuration and spending a few more bits on matrix coefficient updates while maintaining the matrix configuration unchanged.

Interpolated matrixing may be achieved by transmitting slope information to traverse from one primitive matrix for an encoded channel to another that operates on the same channel. The slope may be transmitted as the rate of change of matrix coefficients per access unit ("AU"). If m1 and m2 are primitive matrix coefficients for times which are K access units apart, then the slope to interpolate from m1 to m2 may be defined as delta=(m2−m1)/K.

If coefficients m1 and m2 comprise bits having the following format: m1=a.bcdefg and m2=a.bcuvwx, where both coefficients are specified with a specific number (which may be denoted as "frac_bits") of bits of precision, then slope "delta" would be indicated by a value of the form 0.0000mnop (with higher precision and extra leading zeros required due to the specification of deltas on a per-AU basis). The additional precision required to represent the slope "delta" may be defined as "delta_precision". If an embodiment of the invention includes a step of including each delta value directly in an encoded bitstream, the encoded bitstream would need to include values having a number of bits, "B," which satisfies the expression: B=frac_bits+delta_precision. Clearly it is inefficient to transmit the leading zeros after the decimal place. Thus, in some embodiments, what is coded in the encoded bitstream (which is delivered to the decoder) is a normalized delta (an integer) having form: mnopqr, which is represented with delta_bits plus one sign bit. The delta_bits and delta_precision values may be transmitted in the encoded bitstream as part of the configuration information for the delta matrices. In such embodiments, the decoder is configured to derive the required delta in this case as $$\text{delta}=(\text{normalized delta in bitstream})*2^{-(frac_bits+delta_precision)}.$$

Thus, in some embodiments, the interpolation values included in the encoded bitstream include normalized delta values having Y bits of precision (where Y=frac_bits), and precision values. The normalized delta values are indicative of normalized versions of delta values, where the delta values are indicative of rates of change of coefficients of the primitive matrices, each of the coefficients of the primitive matrices has Y bits of precision, and the precision values are indicative of the increase in precision (i.e., "delta_precision") required to represent the delta values relative to the precision required to represent the coefficients of the primitive matrices. The delta values may be derived by scaling the normalized delta values by a scale factor that is dependent on the resolution of the coefficients of the primitive matrices and the precision values.

Embodiments of the invention may be implemented in hardware, firmware, or software, or a combination thereof (e.g., as a programmable logic array). For example, encoder 40 or 100, or decoder 42 or 102, or subsystems 47, 48, 60, and 61 of decoder 42, or subsystems 110-113 and 106-109 of decoder 102, may be implemented in appropriately programmed (or otherwise configured) hardware or firmware, e.g., as a programmed general purpose processor, digital signal processor, or microprocessor. Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements encoder 40 or 100, or decoder 42 or 102, or subsystem 47, 48, 60, and/or 61 of decoder 42, or subsystems 110-113 and 106-109 of decoder 102), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

While implementations have been described by way of example and in terms of exemplary specific embodiments, it is to be understood that implementations of the invention are not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for encoding an N-channel audio program, wherein the program is specified over a time interval, the time interval includes a subinterval from a time t1 to a time t2, and a time-varying mix, A(t), of N encoded signal channels to M output channels has been specified over the time interval, where M is less than or equal to N, said method including steps of:

determining a first cascade of N×N primitive matrices which, when applied to samples of the N encoded signal channels, implements a first mix of audio content of the N encoded signal channels to the M output channels, wherein the first mix approximates A(t1), and wherein an N×N primitive matrix is defined as a matrix in which N−1 rows contain off-diagonal elements equal to zero and on-diagonal elements with an absolute value of 1;

determining interpolation values which, with the first cascade of primitive matrices and an interpolation function defined over the subinterval, are indicative of a sequence of cascades of N×N updated primitive matrices, such that each of the cascades of updated primitive matrices, when applied to samples of the N encoded signal channels, implements an updated mix, associated with a different time in the subinterval, of the N encoded signal channels to the M output channels, wherein each said updated mix approximates the time-varying mix, A(t), at the time in the subinterval associated with the updated mix; and generating an encoded bitstream which is indicative of encoded audio content, the interpolation values, and the first cascade of primitive matrices.

2. The method of claim 1, wherein each of the primitive matrices is a unit primitive matrix.

3. The method of claim 2, also including a step of generating the encoded audio content by performing matrix operations on samples of the program's N channels, including by applying a sequence of matrix cascades to the samples, wherein each matrix cascade in the sequence is a cascade of primitive matrices, and the sequence of matrix cascades includes a first inverse matrix cascade which is a cascade of inverses of the primitive matrices of the first cascade.

4. The method of claim 2, also including a step of generating the encoded audio content by performing matrix operations on samples of the program's N channels, including by applying a sequence of matrix cascades to the samples, wherein each matrix cascade in the sequence is a cascade of primitive matrices, and each matrix cascade in the sequence is the inverse of a corresponding cascade of the cascades of N×N updated primitive matrices, and N=M, so that the M output channels are the same as the N channels of the program recovered losslessly.

5. The method of claim 1, wherein the first cascade of primitive matrices implements a seed primitive matrix, and the interpolation values are indicative of a seed delta matrix for the seed primitive matrix.

6. The method of claim 4, wherein a time-varying downmix, A2(t), of audio content or encoded content of the program to M1 speaker channels has also been specified over the time interval, where M1 is an integer less than M, and the method also includes a step of:

determining a second cascade of M1×M1 primitive matrices which, when applied to samples of M1 channels of the encoded audio content at each time instant tin the interval implements a downmix of the N-channel audio program to the M1 speaker channels, wherein the downmix approximates the time-varying mix, A2(t).

7. A method for recovery of M channels of an N-channel audio program, wherein the program is specified over a time interval, the time interval includes a subinterval from a time t1 to a time t2, and a time-varying mix, A(t), of N encoded signal channels to M output channels has been specified over the time interval, said method including steps of:

obtaining an encoded bitstream which is indicative of encoded audio content, interpolation values, and a first cascade of N×N primitive matrices, wherein an N×N primitive matrix is defined as a matrix in which N−1 rows contain off-diagonal elements equal to zero and on-diagonal elements with an absolute value of 1; and performing interpolation to determine a sequence of cascades of N×N updated primitive matrices, from the interpolation values, the first cascade of primitive matrices, and an interpolation function over the subinterval, wherein the first cascade of N×N primitive matrices, when applied to samples of N encoded signal channels of the encoded audio content, implements a first mix of audio content of the N encoded signal channels to the M output channels, wherein the first mix approximates A(t1), and the interpolation values, with the first cascade of primitive matrices, and the interpolation function, are indicative of a sequence of cascades of N×N updated primitive matrices, such that each of the cascades of updated primitive matrices, when applied to samples of the N encoded signal channels of the encoded audio content, implements an updated mix, associated with a different time in the subinterval, of the N encoded signal channels to the M output channels, wherein each said updated mix is approximates the time-varying mix, A(t), at the time in the subinterval associated with the updated mix.

8. The method of claim 7, wherein each of the primitive matrices is a unit primitive matrix.

9. The method of claim 8, wherein the encoded audio content has been generated by performing matrix operations on samples of the program's N channels, including by applying a sequence of matrix cascades to the samples, wherein each matrix cascade in the sequence is a cascade of primitive matrices, and each matrix cascade in the sequence is the inverse of a corresponding cascade of the cascades of N×N updated primitive matrices, and N=M, so that the M output channels are the same as the N channels of the program recovered losslessly.

10. The method of claim 9, wherein a time-varying downmix, A2(t), of audio content or encoded content of the program to M1 speaker channels has also been specified over the time interval, where M1 is an integer less than N, and the method also includes steps of:

receiving a second cascade of M1×M1 primitive matrices; and applying the second cascade of M1×M1 to samples of M1 channels of the encoded audio content at each time instant tin the interval to implement a downmix of the N-channel audio program to the M1 speaker channels, wherein the downmix approximates the time-varying mix, A2(t).

11. The method of claim 7, wherein the first cascade of primitive matrices implements a seed primitive matrix, and the interpolation values are indicative of a seed delta matrix for the seed primitive matrix.

12. The method of claim 7, said method also including a step of:

applying at least one of the cascades of updated N×N primitive matrices to samples of the encoded audio content, including by applying a seed primitive matrix and a seed delta matrix separately to the samples of the encoded audio content to generate transformed samples, and linearly combining the transformed samples in accordance with the interpolation function, thereby generating recovered samples indicative of samples of the M channels of the N-channel audio program.

13. The method of claim 7, wherein the interpolation function is constant over some intervals of the encoded bitstream, and each most recently updated one of the cascades of N×N updated primitive matrices is updated by interpolation only during an interval of the encoded bitstream in which the interpolation function is not substantially constant.

14. The method of claim 7, wherein the interpolation values include normalized delta values representable with Y bits, an indication of this number of bits of precision, and precision values, where the normalized delta values are indicative of normalized versions of delta values, the delta values are indicative of rates of change of coefficients of the primitive matrices, and the precision values indicative an increase in precision required to represent the delta values relative to the precision required to represent the coefficients of the primitive matrices.

15. The method of claim 14, wherein the delta values are derived by scaling the normalized delta values by a scale factor that is dependent on the resolution of the coefficients of the primitive matrices and the precision values.

16. The method of claim 7, also including steps of:

extracting a check word from the encoded bitstream, and verifying whether channels of a segment of the audio program have been correctly recovered, by comparing a second check word derived from audio samples generated by said matrix multiplication subsystem against the check word extracted from the encoded bitstream.

17. An audio encoder configured to encode an N-channel audio program, wherein the program is specified over a time interval, the time interval includes a subinterval from a time t1 to a time t2, and a time-varying mix, A(t), of N encoded signal channels to M output channels has been specified over the time interval, where M is less than or equal to N, and wherein said encoder is configured to perform the method of claim 1.

18. A decoder configured to implement recovery of an N-channel audio program, wherein the program is specified over a time interval, the time interval includes a subinterval from a time t1 to a time t2, and a time-varying mix, A(t), of N encoded signal channels to M output channels has been specified over the time interval, and wherein said decoder is configured to perform the method of claim 7.

19. A non-transitory computer readable storage medium comprising a program of instructions, which, when executed by an audio encoder, cause the audio encoder to perform the method of claim 1.

20. A non-transitory computer readable storage medium comprising a program of instructions, which, when executed by a decoder, cause the decoder to perform the method of claim 7.

* * * * *